US008670990B2

(12) United States Patent
Chen et al.

(10) Patent No.: US 8,670,990 B2
(45) Date of Patent: Mar. 11, 2014

(54) DYNAMIC TIME SCALE MODIFICATION FOR REDUCED BIT RATE AUDIO CODING

(75) Inventors: Juin-Hwey Chen, Irvine, CA (US); Hong-Goo Kang, Seoul (KR); Robert W. Zopf, Rancho Santa Margarita, CA (US); Jes Thyssen, San Juan Capistrano, CA (US)

(73) Assignee: Broadcom Corporation, Irvine, CA (US)

( * ) Notice: Subject to any disclaimer, the term of this patent is extended or adjusted under 35 U.S.C. 154(b) by 228 days.

(21) Appl. No.: 12/847,120

(22) Filed: Jul. 30, 2010

(65) Prior Publication Data

US 2011/0029317 A1 Feb. 3, 2011

Related U.S. Application Data

(60) Provisional application No. 61/231,004, filed on Aug. 3, 2009.

(51) Int. Cl.
*G10L 21/04* (2013.01)
*G10L 11/06* (2006.01)

(52) U.S. Cl.
USPC ..... 704/503; 704/214; 704/215; 704/504

(58) Field of Classification Search
USPC ..... 704/208, 210, 214, 215, 220, 503, 504
See application file for complete search history.

(56) References Cited

U.S. PATENT DOCUMENTS 5,657,418 A 8/1997 Gerson et al.
5,749,064 A * 5/1998 Pawate et al. ..... 704/213
5,828,994 A * 10/1998 Covell et al. ..... 704/211
5,966,688 A * 10/1999 Nandkumar et al. ..... 704/222
6,128,591 A 10/2000 Taori et al.
6,219,636 B1 4/2001 Ihara
6,415,252 B1 7/2002 Peng et al.
6,475,245 B2 * 11/2002 Gersho et al. ..... 704/208
6,484,137 B1 * 11/2002 Taniguchi et al. ..... 704/211
6,507,814 B1 1/2003 Gao
6,510,407 B1 1/2003 Wang
6,584,437 B2 6/2003 Heikkinen et al.
6,584,438 B1 6/2003 Manjunath et al.

(Continued)

OTHER PUBLICATIONS

Eriksson et al., "Pitch quantization in low bit-rate speech coding", IEEE International Conference on Acoustics, Speech, and Signal Processing, vol. 1, Mar. 15-19, 1999, pp. 489-492.

(Continued)

*Primary Examiner* — Martin Lerner
(74) *Attorney, Agent, or Firm* — Fiala & Weaver P.L.L.C.

(57) ABSTRACT

Systems and methods are described that utilize dynamic time scale modification (TSM) to achieve reduced bit rate audio coding. In accordance with embodiments, different levels of TSM compression are selectively applied to segments of an input speech signal prior to encoding thereof by an encoder. Encoded TSM-compressed segments are received at a decoder which decodes such segments and then applies an appropriate level of TSM decompression to each based on information received from the encoder. By selectively applying different levels of TSM compression to segments of an input speech signal prior to encoding, a coding bit rate associated with the encoder/decoder is reduced. Furthermore, by selecting a level of TSM compression for each segment of the input speech signal that takes into account certain local characteristics of that signal, such bit rate reduction is provided without introducing unacceptable levels of distortion into an output speech signal produced by the decoder.

22 Claims, 14 Drawing Sheets

(56) References Cited

U.S. PATENT DOCUMENTS

| | | | | |
|---|---|---|---|---|
| 6,625,226 | B1 * | 9/2003 | Gersho et al. | 375/285 |
| 6,687,666 | B2 | 2/2004 | Ehara et al. | |
| 6,691,082 | B1 * | 2/2004 | Aguilar et al. | 704/219 |
| 7,039,584 | B2 | 5/2006 | Gournay et al. | |
| 7,047,185 | B1 | 5/2006 | Younes et al. | |
| 7,171,355 | B1 | 1/2007 | Chen | |
| 7,272,556 | B1 * | 9/2007 | Aguilar et al. | 704/230 |
| 7,337,108 | B2 * | 2/2008 | Florencio et al. | 704/208 |
| 7,426,470 | B2 * | 9/2008 | Chu et al. | 704/503 |
| 7,478,042 | B2 | 1/2009 | Ehara et al. | |
| 7,747,430 | B2 | 6/2010 | Mäkinen | |
| 7,912,710 | B2 * | 3/2011 | Sasaki et al. | 704/210 |
| 7,917,357 | B2 * | 3/2011 | Florencio et al. | 704/215 |
| 7,957,960 | B2 * | 6/2011 | Chen | 704/211 |
| 8,032,360 | B2 * | 10/2011 | Chen | 704/211 |
| 8,078,456 | B2 * | 12/2011 | Chen et al. | 704/218 |
| 8,279,889 | B2 | 10/2012 | Rajendran et al. | |
| 8,321,216 | B2 * | 11/2012 | Zopf | 704/228 |
| 8,392,178 | B2 | 3/2013 | Vos | |
| 2001/0018650 | A1 * | 8/2001 | DeJaco | 704/200.1 |
| 2002/0038209 | A1 * | 3/2002 | Brandel et al. | 704/207 |
| 2003/0033140 | A1 * | 2/2003 | Taori et al. | 704/214 |
| 2003/0200092 | A1 * | 10/2003 | Gao et al. | 704/258 |
| 2004/0167772 | A1 | 8/2004 | Erzin | |
| 2004/0267525 | A1 * | 12/2004 | Lee et al. | 704/208 |
| 2005/0228648 | A1 | 10/2005 | Heikkinen | |
| 2005/0254783 | A1 * | 11/2005 | Chen | 386/68 |
| 2007/0094031 | A1 * | 4/2007 | Chen | 704/267 |
| 2007/0192092 | A1 * | 8/2007 | Huang | 704/230 |
| 2007/0219787 | A1 * | 9/2007 | Manjunath et al. | 704/207 |
| 2008/0052068 | A1 * | 2/2008 | Aguilar et al. | 704/230 |
| 2008/0162121 | A1 | 7/2008 | Son et al. | |
| 2008/0304678 | A1 * | 12/2008 | Chen et al. | 381/71.12 |
| 2011/0029304 | A1 | 2/2011 | Chen et al. | |
| 2011/0125505 | A1 | 5/2011 | Vaillancourt et al. | |
| 2011/0208517 | A1 * | 8/2011 | Zopf | 704/211 |

OTHER PUBLICATIONS

Chen et al., "The Broadvoice Speech Coding Algorithm", IEEE International Conference on Acoustics, Speech and Signal Processing, vol. 4, Apr. 15-20, 2007, 4 pages.

* cited by examiner

DYNAMIC TIME SCALE MODIFICATION FOR REDUCED BIT RATE AUDIO CODING

CROSS-REFERENCE TO RELATED APPLICATIONS

This application claims priority to U.S. Provisional Patent Application No. 61/231,004, filed Aug. 3, 2009 and entitled "Methods and Systems for Multi-Mode Variable-Bit-Rate Speech Coding," the entirety of which is incorporated by reference herein.

BACKGROUND OF THE INVENTION

1. Field of the Invention

The present invention generally relates to systems that encode audio signals, such as speech signals, for transmission or storage and/or that decode encoded audio signals for playback.

2. Background

Speech coding refers to the application of data compression to audio signals that contain speech, which are referred to herein as "speech signals." In speech coding, a "coder" encodes an input speech signal into a digital bit stream for transmission or storage, and a "decoder" decodes the bit stream into an output speech signal. The combination of the coder and the decoder is called a "codec." The goal of speech coding is usually to reduce the encoding bit rate while maintaining a certain degree of speech quality. For this reason, speech coding is sometimes referred to as "speech compression" or "voice compression."

The encoding of a speech signal typically involves applying signal processing techniques to estimate parameters that model the speech signal. In many coders, the speech signal is processed as a series of time-domain segments, often referred to as "frames" or "sub-frames," and a new set of parameters is calculated for each segment. Data compression algorithms are then utilized to represent the parameters associated with each segment in a compact bit stream. Different codecs may utilize different parameters to model the speech signal. By way of example, the BROADVOICE16™ ("BV16") codec, which is described by J.-H. Chen and J. Thyssen in "The BroadVoice Speech Coding Algorithm," Proceedings of 2007 IEEE International Conference on Acoustics, Speech and Signal Processing, pp. IV-537-IV-540, April 2007, is a two-stage noise feedback codec that encodes Line-Spectrum Pair (LSP) parameters, a pitch period, three pitch taps, excitation gain and excitation vectors associated with each 5 ms frame of an audio signal. Other codecs may encode different parameters.

As noted above, the goal of speech coding is usually to reduce the encoding bit rate while maintaining a certain degree of speech quality. There are many practical reasons for seeking to reduce the encoding bit rate. Motivating factors may include, for example, the conservation of bandwidth in a two-way speech communication scenario or the reduction of memory requirements in an application that stores encoded speech for subsequent playback. To this end, codec designers are often tasked with reducing the number of bits required to generate an encoded representation of each speech signal segment. This may involve modifying the way a codec models speech and/or reducing the number of bits used to represent one or more parameters associated with a particular speech model. However, to provide a decoded speech signal of good or even reasonable quality, there are limits to the amount of compression that can be applied by any coder. What is needed, then, are techniques for reducing the encoding bit rate of a codec in a manner that will result in relatively little degradation of a decoded speech signal generated by the codec.

BRIEF SUMMARY OF THE INVENTION

Systems and methods are described herein that utilize dynamic time scale modification (TSM) to achieve reduced bit rate audio coding. In accordance with certain embodiments, different levels of TSM compression are selectively applied to segments of an input speech signal prior to encoding thereof by an encoder. The encoded TSM-compressed segments are received at a decoder that decodes the encoded TSM-compressed segments and then applies an appropriate level of TSM decompression to each based on information received from the encoder. By selectively applying different levels of TSM compression to segments of an input speech signal prior to encoding, systems and methods in accordance with embodiments of the invention reduce a coding bit rate associated with the encoder/decoder. Furthermore, by selecting a level of TSM compression for each segment of the input speech signal that takes into account certain local characteristics of that signal, systems and methods in accordance with embodiments of the invention can provide such bit rate reduction without introducing unacceptable levels of distortion into an output speech signal produced by the decoder.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable a person skilled in the relevant art(s) to make and use the invention.

Figure 9:
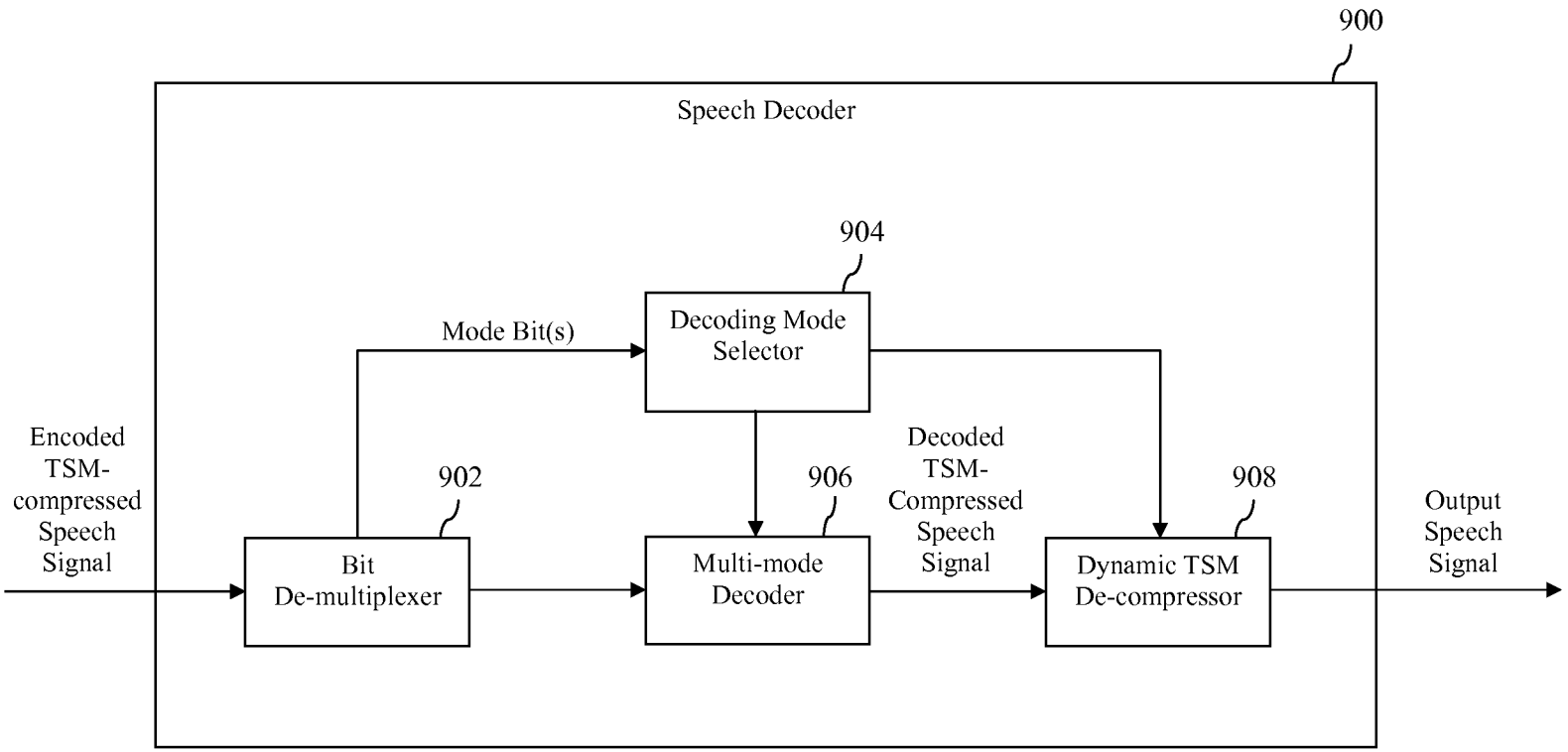
Figure 10:
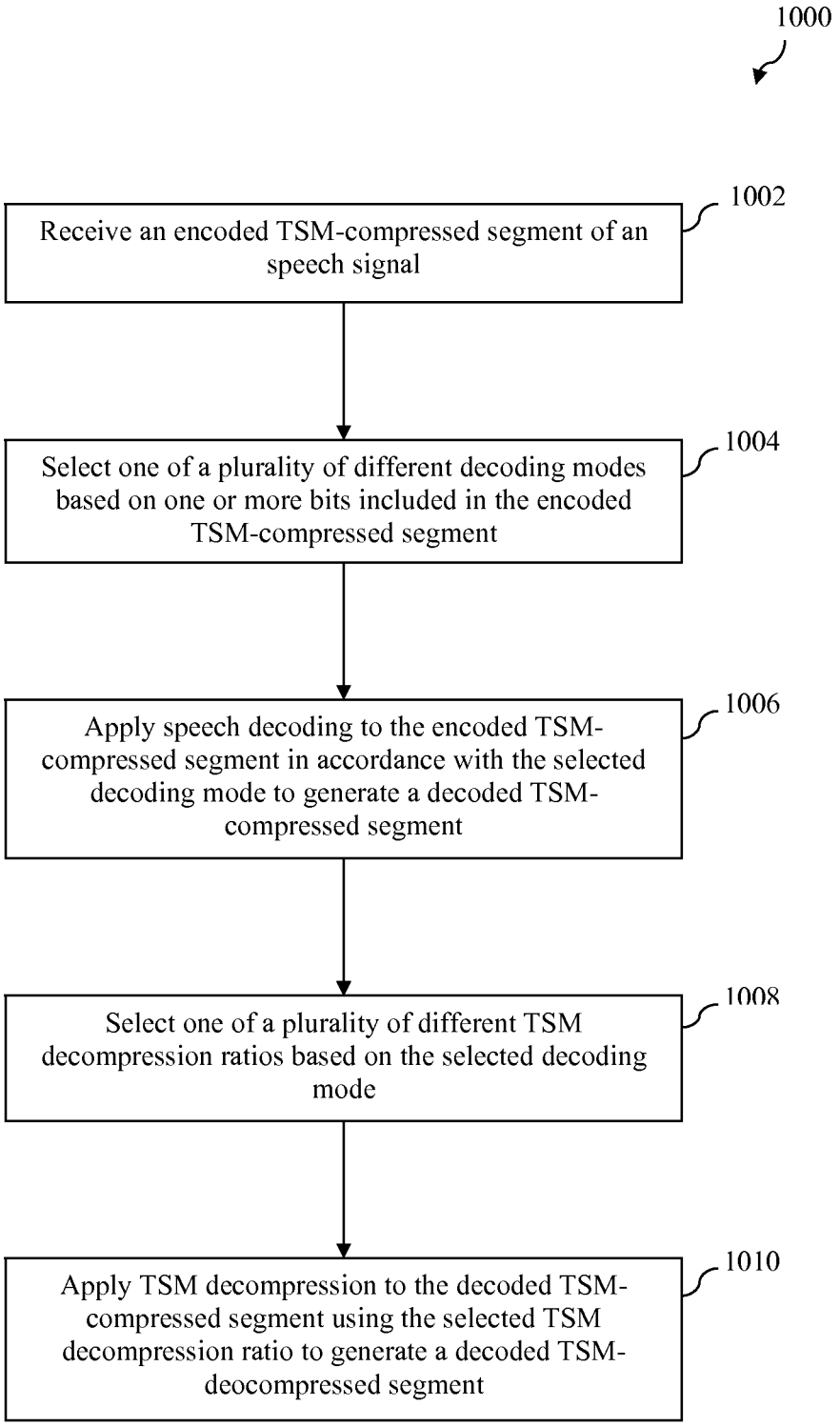

FIG. 9 is a block diagram of an example speech decoder that that applies speech decoding and dynamic TSM decompression to an encoded TSM-compressed speech signal in accordance with an alternate embodiment of the present invention FIG. 10 depicts a flowchart of a method for decoding an encoded representation of a speech signal that utilizes dynamic TSM decompression to reduce a coding bit rate in accordance with an alternate embodiment of the present invention.

Figure 11:
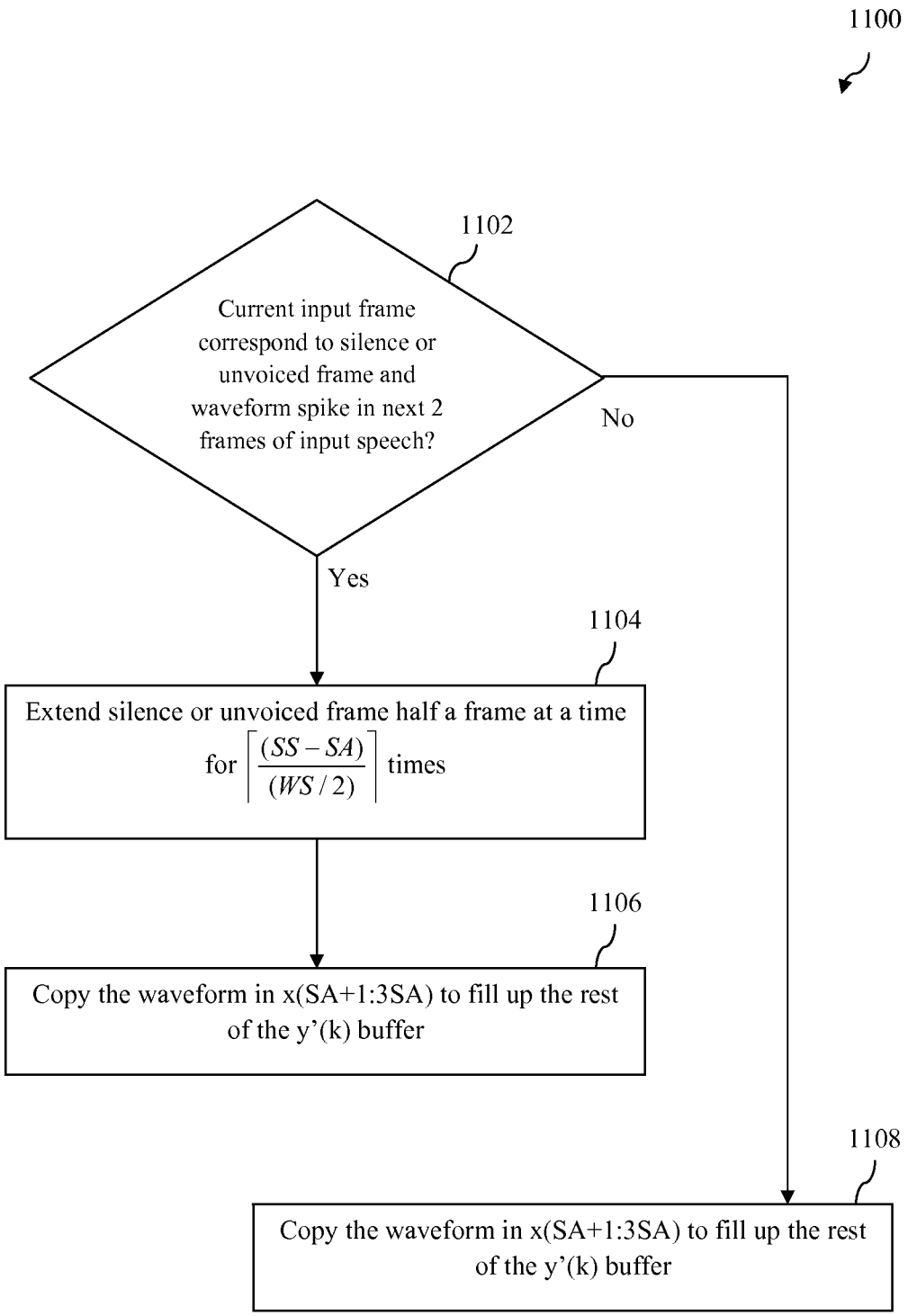

FIG. 11 depicts a flowchart of a method for avoiding waveform spike duplication during TSM decompression in accordance with an embodiment of the present invention.

Figure 12:
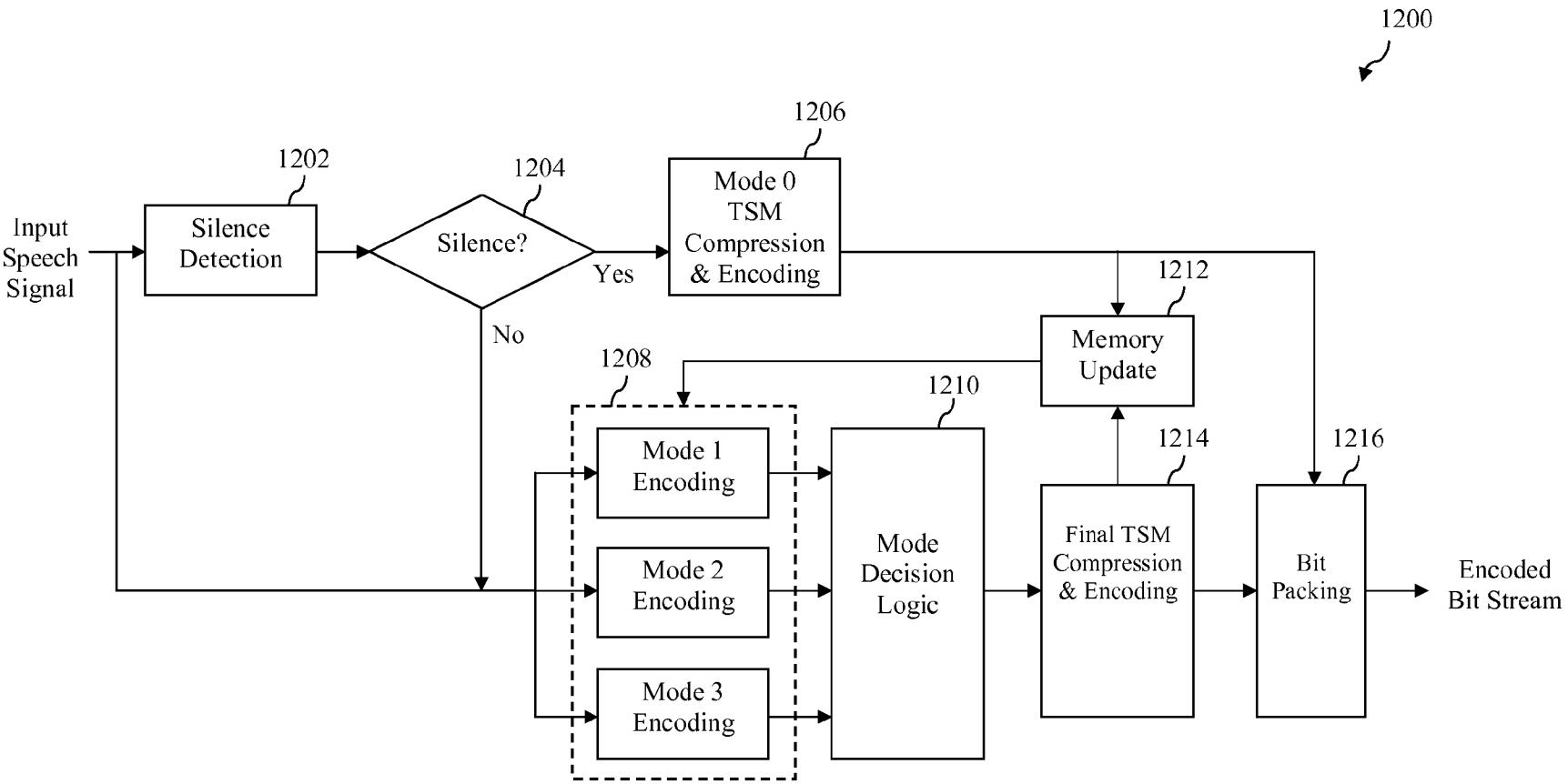

FIG. 12 is a block diagram of a multi-mode encoder that utilizes dynamic TSM compression in accordance with a particular embodiment of the present invention.

Figure 13:
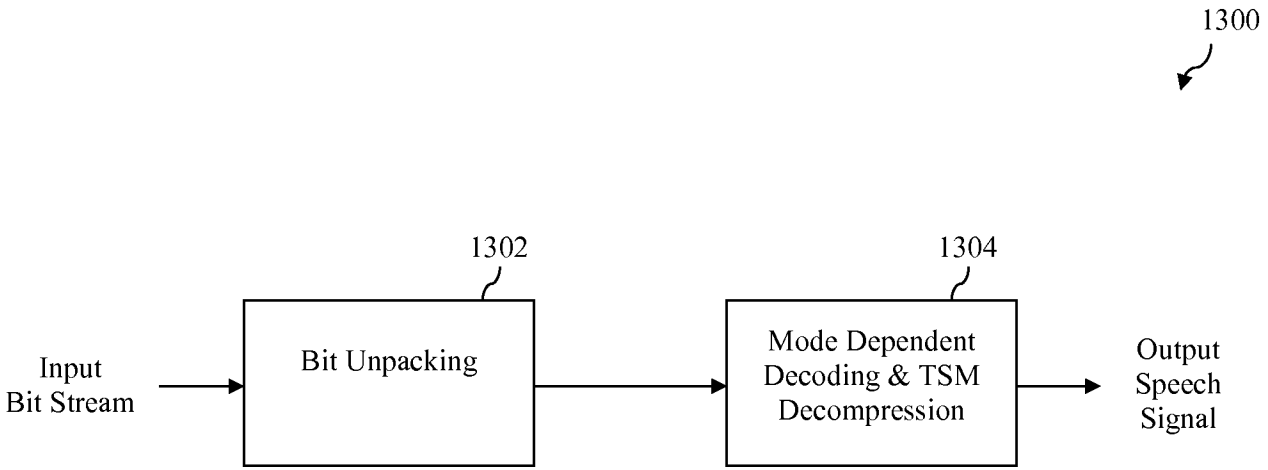

FIG. 13 is a block diagram of a multi-mode decoder that utilizes dynamic TSM decompression in accordance with a particular embodiment of the present invention.

Figure 14:
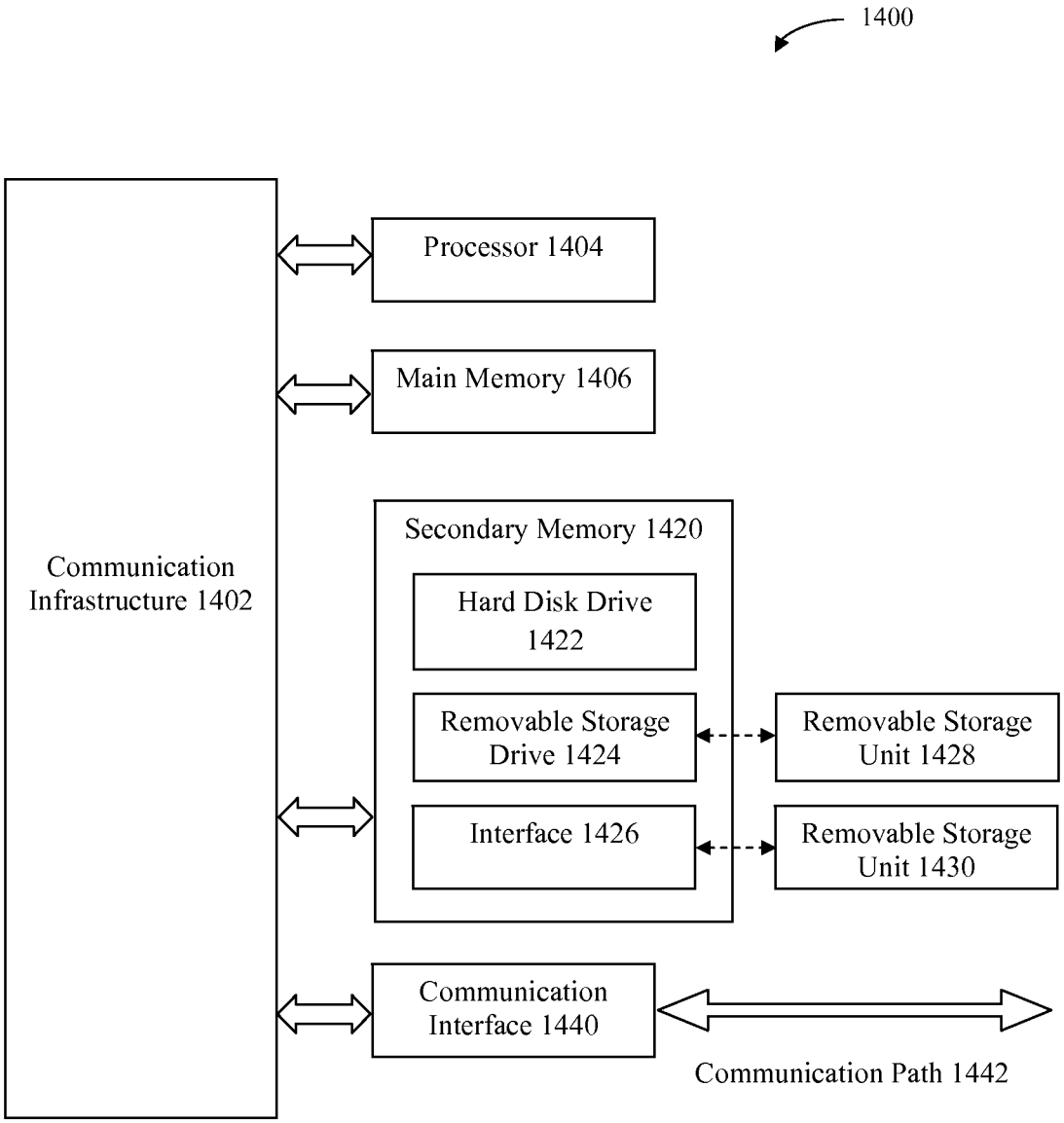

FIG. 14 is a block diagram of an example computer system that may be used to implement aspects of the present invention.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION OF THE INVENTION

A. Introduction

The following detailed description refers to the accompanying drawings that illustrate exemplary embodiments consistent with this invention. Other embodiments are possible, and modifications may be made to the embodiments within the spirit and scope of the present invention. Therefore, the following detailed description is not meant to limit the invention. Rather, the scope of the invention is defined by the appended claims.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to implement such feature, structure, or characteristic in connection with other embodiments whether or not explicitly described.

B. Example Systems in Accordance with Embodiments of the Present Invention

Exemplary systems in accordance with embodiments of the present invention that perform dynamic time scale modification (TSM) for reduced bit rate audio coding will now be described. These systems are described herein by way of example only and are not intended to limit the present invention. Persons skilled in the relevant art(s) will readily appreciate that a dynamic TSM/audio coding scheme in accordance with an embodiment of the present invention may be implemented in systems other than those described herein.

Figure 1:
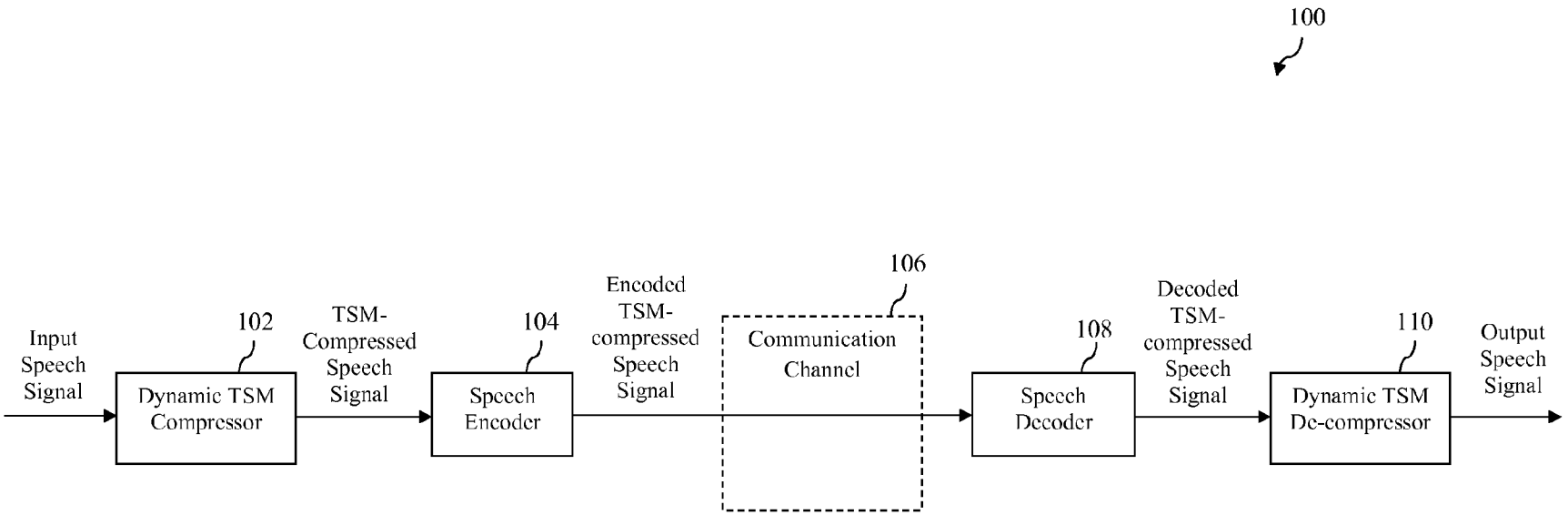
FIG. 1 is a block diagram of a system in accordance with an embodiment of the present invention that performs speech coding in support of real-time speech communication and that utilizes dynamic time scale modification (TSM) functionality to reduce a coding bit rate associated with a speech encoder and decoder of the system.

In particular, FIG. 1 is a block diagram of an example system 100 in accordance with an embodiment of the present invention that performs speech coding in support of real-time speech communication and that utilizes dynamic TSM functionality to reduce a coding bit rate associated with a speech encoder and speech decoder of the system.

As shown in FIG. 1, system 100 includes a dynamic TSM compressor 102 that receives an input speech signal. Dynamic TSM compressor 102 processes the input speech signal as a series of discrete time domain segments which may be referred to, for example, as "frames" or "sub-frames." For each segment of the input speech signal, dynamic TSM compressor 102 selects one of a plurality of different TSM compression ratios and then applies TSM compression to the segment using the selected TSM compression ratio to generate a TSM-compressed segment. The TSM compression ratio that is selected is preferably the ratio that will provide the greatest amount of TSM compression while introducing the least amount of speech distortion. The selection may be made, for example, based on certain local characteristics of the input speech signal. Various approaches for selecting the appropriate TSM compression ratio for a given segment will be described herein. Dynamic TSM compressor 102 then outputs the TSM-compressed segment. The TSM-compressed segments output by dynamic TSM compressor 102 collectively comprise a TSM-compressed speech signal.

A speech encoder 104 receives the TSM-compressed speech signal and applies a speech encoding algorithm thereto to generate an encoded TSM-compressed speech signal. In particular, speech encoder 104 applies a speech encoding algorithm to each TSM-compressed segment of the TSM-compressed speech signal to generate an encoded TSM-compressed segment. Each encoded TSM-compressed segment includes one or more bits that indicate which TSM compression ratio was used by dynamic TSM compressor 102 in applying TSM compression to the segment. The encoded TSM-compressed speech signal, which comprises a series of encoded TSM-compressed segments, is transmitted via a communication channel 106 to a speech decoder 108 in real-time.

Speech decoder 108 receives the encoded TSM-compressed speech signal and applies a speech decoding algorithm thereto to generate a decoded TSM-compressed speech signal. In particular, speech decoder 108 applies a speech decoding algorithm to each encoded TSM-compressed segment of the encoded TSM-compressed speech signal to generate a decoded TSM-compressed segment. The decoded TSM-compressed speech signal, which comprises a series of decoded TSM-compressed segments, is then output to a dynamic TSM de-compressor 110.

Dynamic TSM de-compressor 110 receives the decoded TSM-compressed speech signal. For each decoded TSM-compressed segment of the decoded TSM-compressed speech signal, dynamic TSM de-compressor 110 selects one of a plurality of different TSM decompression ratios and then applies TSM decompression to the decoded TSM-compressed segment using the selected TSM decompression ratio to generate a decoded segment. Dynamic TSM de-compressor 110 selects the TSM decompression ratio based on the bit(s) included in the encoded TSM-compressed version of the segment that indicate the compression ratio that was applied to the segment by dynamic TSM compressor 102. In one embodiment, TSM de-compressor 110 applies a decompression ratio that is an inverse of the compression ratio that was applied to the segment by dynamic TSM compressor 102, thereby undoing the effect of the TSM compression applied by dynamic TSM compressor 102. However, the invention is not so limited, and TSM de-compressor 110 may apply a decompression ratio that is not the inverse of the compression ratio that was applied to the segment by dynamic TSM compressor 102, or even no decompression at all. The decoded segments output by dynamic TSM de-compressor 110 collectively comprise an output speech signal which may then be played back to a user.

As will be appreciated by persons skilled in the relevant art(s), the term "TSM expansion" generally refers to any process by which the time axis associated with an audio signal is lengthened, thereby slowing down the playback of the audio signal. As used herein, the term "TSM decompression" generally refers to the application of TSM expansion to an audio signal to which TSM compression has been previously applied. It is to be understood, however, that certain aspects of the present invention described herein in terms of "TSM decompression" may also be implemented using TSM expansion. For example, the spike duplication avoidance method described in Section E.2 may be utilized in any system or process that applies TSM expansion to an audio signal, regardless of whether that audio signal is a TSM-compressed audio signal.

By selectively applying different levels of TSM compression to segments of the input speech signal, system 100 reduces the amount of data that must be encoded by speech encoder 104 and decoded by speech decoder 108, thus reducing the coding bit rate associated with those components. Furthermore, as will be described in more detail herein, by selecting a level of TSM compression for each segment of the input speech signal that takes into account certain local characteristics of that signal, system 100 can provide such bit rate reduction without introducing unacceptable levels of distortion into the output speech signal produced by the system.

Any of a variety of audio TSM algorithms may be used by dynamic TSM compressor 102 to perform TSM compression and by dynamic TSM de-compressor 110 to perform TSM decompression. For example, a Synchronized Overlap Add (SOLA) algorithm may be used, such as that described in S. Roucos and A. M. Wilgus, "High Quality Time-Scale Modification for Speech," Proceedings of 1985 IEEE International Conference on Acoustic, Speech and Signal Processing, pp. 493-496 (March 1985), the entirety of which is incorporated by reference herein. In an alternative embodiment, a Decimation-based SOLA (DSOLA) algorithm is used, such as that described in U.S. Patent Application Publication No. 2007/0094031 to Chen (filed Oct. 20, 2006) and in U.S. Patent Application Publication 2008/0304678 to Chen et al. (filed May 12, 2008), the entireties of which are incorporated by reference herein. The DSOLA algorithm may be deemed preferable to the SOLA algorithm since it has significantly lower computation complexity than SOLA while providing comparable performance. Still other suitable TSM algorithms may be used.

Speech encoder 104 and speech decoder 108 may represent modified components of any of a wide variety of speech codecs that operate to encode an input speech signal into a compressed bit stream and to decode the compressed bit stream to produce an output speech signal. At a minimum, the modified encoder must be capable of encoding TSM-compressed segments of an input speech signal and of providing data within each encoded segment that can be used to determine what level of TSM-compression was applied to the segment. The modified decoder must be capable of interpreting such data so that it can inform a TSM de-compressor what level of TSM-compression was applied to the segment and of producing decoded TSM-compressed segments that are suitable for processing by such a TSM de-compressor.

In one embodiment, speech encoder 104 and speech decoder 108 comprise modified components of either of the BROADVOICE16™ ("BV16") or BROADVOICE32™ ("BV32") speech codecs described by J.-H. Chen and J. Thyssen in "The BroadVoice Speech Coding Algorithm," Proceedings of 2007 IEEE International Conference on Acoustics, Speech and Signal Processing, pp. IV-537-IV-540, April 2007, the entirety of which is incorporated by reference herein. In a particular embodiment described herein, speech encoder 104 and speech decoder 108 are components of a multi-mode, variable bit rate speech codec built upon the BV16 or BV32 codec. As another example, speech encoder 104 and speech decoder 108 may represent modified components of any of a wide variety of Code Excited Linear Prediction (CELP) codecs that operate to encode an input speech signal into a compressed bit stream and to decode the compressed bit stream to produce an output speech signal. However, these examples are not intended to be limiting and persons skilled in the relevant art(s) will appreciate that other speech or audio codecs may be used.

Although FIG. 1 shows a dynamic TSM compressor/speech encoder on one side of communication channel 106 and a speech decoder/dynamic TSM de-compressor on the other side of communication channel 106, persons skilled in the relevant art(s) will appreciate that a dynamic TSM compressor/speech encoder and a speech decoder/dynamic TSM de-compressor may be provided on both sides of communication channel 106 to support a two-way real-time speech communication scenario. Although these additional components have not been shown in FIG. 1 for the sake of convenience, persons skilled in the relevant art(s) will appreciate that system 100 may include such components and that such components may also advantageously utilize dynamic TSM functionality to reduce a coding bit rate in accordance with the present invention.

Figure 2:
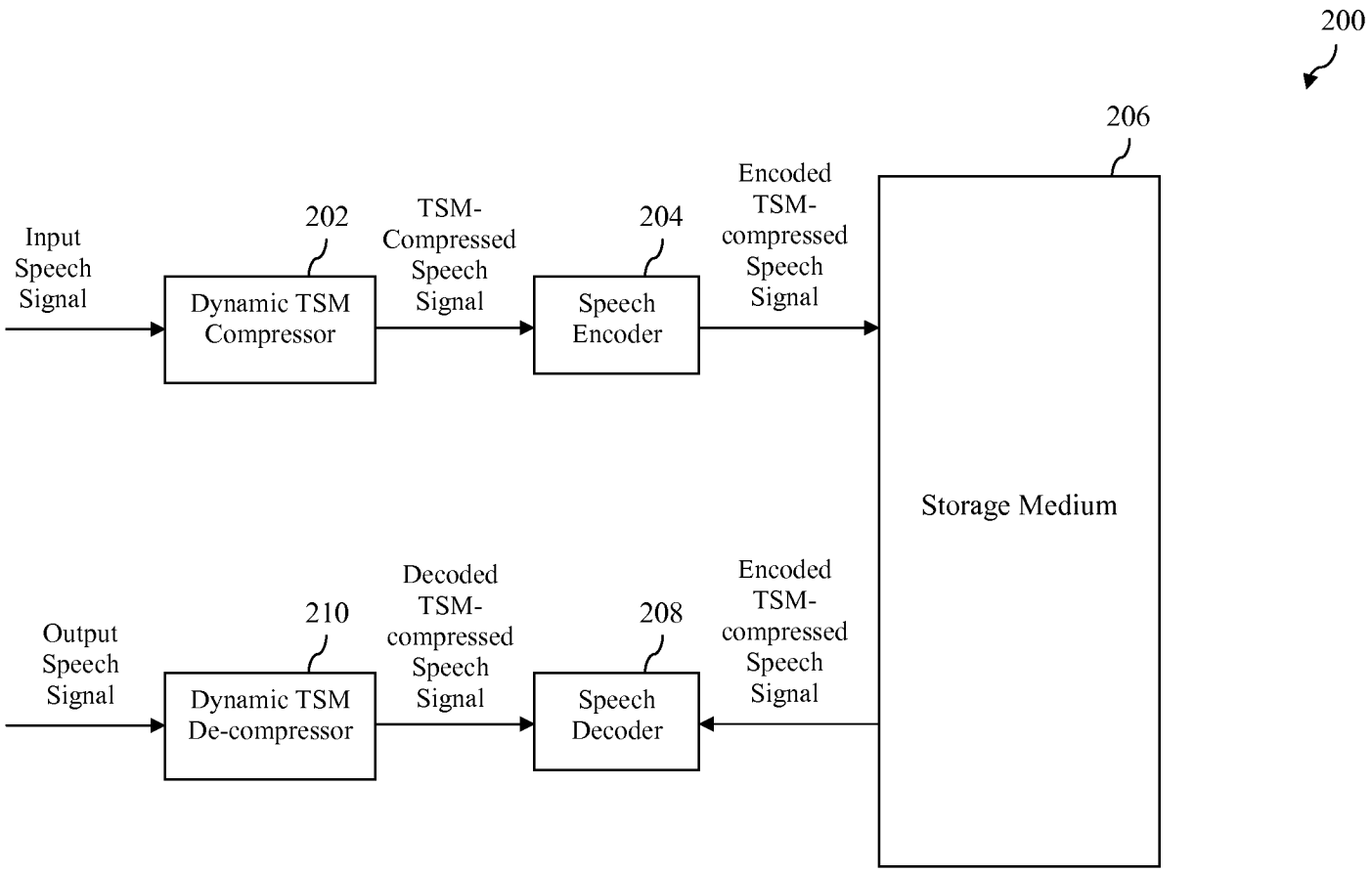
FIG. 2 is a block diagram of a system in accordance with another embodiment of the present invention that performs speech coding in support of a speech storage application and that utilizes dynamic TSM functionality to reduce a coding bit rate associated with a speech encoder and speech decoder of the system.

FIG. 2 is a block diagram of a system 200 in accordance with another embodiment of the present invention that performs speech coding and that utilizes dynamic TSM functionality to reduce a coding bit rate associated with a speech encoder and speech decoder of the system. However, unlike system 100 which performs speech coding in support of real-time speech communication, system 200 performs speech coding in support of a speech storage application in which the encoded TSM-compressed representation of the speech signal is stored in a storage medium for later play back. Examples of such speech storage applications include, but are not limited to, audio books, talking toys, and voice prompts stored in voice response systems, BLUETOOTH™ headsets or Personal Navigation Devices with BLUETOOTH™ telephony support.

As shown in FIG. 2, system 200 includes a dynamic TSM compressor 202 that receives an input speech signal and processes the input speech signal as a series of discrete time domain segments. For each segment of the input speech signal, dynamic TSM compressor 202 selects one of a plurality of different TSM compression ratios and then applies TSM compression to the segment using the selected TSM compression ratio to generate a TSM-compressed segment. Dynamic TSM compressor 202 then outputs the TSM-compressed segment. The TSM-compressed segments output by dynamic TSM compressor 202 collectively comprise a TSM-compressed speech signal.

As further shown in FIG. 2, a speech encoder 204 receives the TSM-compressed speech signal and applies a speech encoding algorithm thereto to generate an encoded TSM-compressed speech signal. In particular, speech encoder 204 applies a speech encoding algorithm to each TSM-compressed segment of the TSM-compressed speech signal to generate an encoded TSM-compressed segment. Each encoded TSM-compressed segment includes one or more bits that indicate which TSM compression ratio was used by dynamic TSM compressor 202 in applying TSM compression to the segment. The encoded TSM-compressed speech signal, which comprises a series of encoded TSM-compressed segments, is stored in a storage medium 206 and is later retrieved and provided to a speech decoder 208.

Speech decoder 208 receives the encoded TSM-compressed speech signal from storage medium 206 and applies a speech decoding algorithm thereto to generate a decoded TSM-compressed speech signal. In particular, speech decoder 208 applies a speech decoding algorithm to each encoded TSM-compressed segment of the encoded TSM-compressed speech signal to generate a decoded TSM-compressed segment. The decoded TSM-compressed speech signal, which comprises a series of decoded TSM-compressed segments, is then output to a dynamic TSM de-compressor 210.

Dynamic TSM de-compressor 210 receives the decoded TSM-compressed speech signal. For each decoded TSM-compressed segment of the decoded TSM-compressed speech signal, dynamic TSM de-compressor 210 selects one of a plurality of different TSM decompression ratios and then applies TSM decompression to the decoded TSM-compressed segment using the selected TSM decompression ratio to generate a decoded segment. Dynamic TSM de-compressor 210 selects the TSM decompression ratio based on the bit(s) included in the encoded TSM-compressed version of the segment that indicate the compression ratio that was applied to the segment by dynamic TSM compressor 202. The decoded segments output by dynamic TSM de-compressor 210 collectively comprise an output speech signal which may then be played back to a user.

In a like manner to system 100 of FIG. 1, system 200 reduces the amount of data that must be encoded by speech encoder 204 and decoded by speech decoder 208 by selectively applying different levels of TSM compression to segments of the input speech signal, thus reducing the coding bit rate associated with those components. The application of TSM compression in this manner also reduces the amount of data that must be stored on storage medium 206. Furthermore, in a like manner to system 100 of FIG. 1, system 100 can provide such bit rate reduction without introducing unacceptable levels of distortion into the output speech signal produced by the system by selecting a level of TSM compression for each segment of the input speech signal that takes into account certain local characteristics of that signal.

Any of a variety of audio TSM algorithms may be used by dynamic TSM compressor 202 to perform TSM compression and by dynamic TSM de-compressor 210 to perform TSM decompression, including but not limited to the SOLA and DSOLA algorithms mentioned above. Furthermore, speech encoder 204 and speech decoder 208 may represent modified components of any of a wide variety of speech codecs that operate to encode an input speech signal into a compressed bit stream and to decode the compressed bit stream to produce an output speech signal, including but not limited to modified versions of the BV16 and BV32 speech codecs or any of a variety of well-known CELP codecs.

Figure 3:
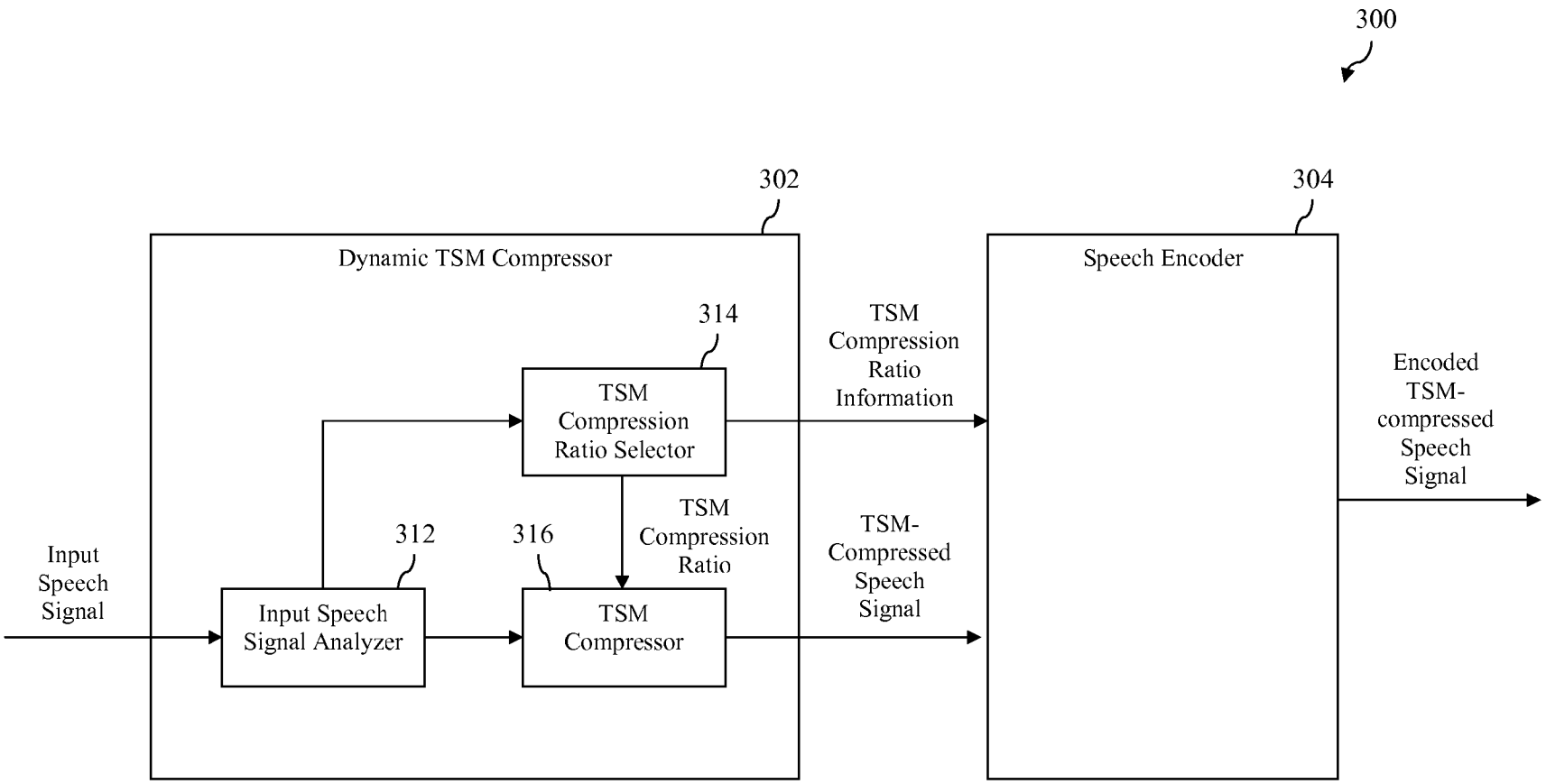
FIG. 3 is a block diagram of an example system that applies dynamic TSM compression and speech encoding to an input speech signal in accordance with an embodiment of the present invention.

C. Example Dynamic TSM Compressor/Encoder in Accordance with Embodiments of the Present Invention FIG. 3 is a block diagram of an example system 300 that applies dynamic TSM compression and speech encoding to an input speech signal in accordance with an embodiment of the present invention. As shown in FIG. 3, system 300 includes a dynamic TSM compressor 302 and a speech encoder 304. Dynamic TSM compressor 302 and speech encoder 304 may represent an implementation of dynamic TSM compressor 102 and speech encoder 104 as described above in reference to system 100 of FIG. 1 or dynamic TSM compressor 202 and speech encoder 204 as described above in reference to system 200 of FIG. 2. However, these are only examples and dynamic TSM compressor 302 and speech encoder 304 may be used in other systems as well.

As will be appreciated by persons skilled in the relevant art(s), each of dynamic TSM compressor 302 and speech encoder 304, as well as any sub-components thereof, may be implemented in software, through the execution of instructions by one or more general-purpose or special-purpose processors, in hardware, using analog and/or digital circuits, or as a combination of software and hardware.

Generally speaking, dynamic TSM compressor 302 is configured to receive an input speech signal and, for each segment of the input speech signal, to select one of a plurality of different TSM compression ratios and to apply TSM compression to the segment using the selected TSM compression ratio to generate a TSM-compressed segment. Dynamic TSM compressor 302 then outputs a TSM-compressed speech signal that comprises a series of such TSM-compressed segments. As shown in FIG. 3, dynamic TSM compressor 302 includes a plurality of interconnected components including an input speech signal analyzer 312, a TSM compression ratio selector 314 and a TSM compressor 316. Each of these components will now be described.

Input speech signal analyzer 312 is configured to receive the input speech signal and to analyze local characteristics associated therewith to generate information that can be used by TSM compression ratio selector 314 to determine which of a plurality of TSM compression ratios should be applied to each segment of the input speech signal. In generating such information, input speech signal analyzer 312 may analyze the segment for which the TSM compression ratio is being selected, one or more segments that precede that segment, one or more segments that follow that segment, or any combination thereof.

Generally speaking, input speech signal analyzer 312 analyzes local characteristics of the input speech signal to help determine the extent to which a segment can be TSM-compressed without introducing an unacceptable amount of speech distortion. In one embodiment, input speech signal analyzer 312 performs this function by analyzing local characteristics of the input speech signal to determine whether the segment is one of silence, unvoiced speech, stationary voiced speech or non-stationary voiced speech (e.g., onset or transient segments). It has been observed that a relatively high TSM compression ratio can be used for segments that represent silence, unvoiced speech, and stationary voiced speech without introducing significant speech distortion. This is true for silence segments because such segments by definition do not include speech. This is true for stationary voiced speech segments because such segments are quasi-periodic in nature and SOLA-based TSM compression techniques are effective at maintaining the pitch period associated with such segments. This is also true to some extent for unvoiced speech segments because such speech segments tend to be steady-state in nature. In contrast, non-stationary voiced speech segments tend to become noticeably distorted when too much TSM compression is applied.

In a further embodiment, input speech signal analyzer 312 may analyze a segment to estimate an amount of distortion that will be introduced by applying TSM compression to the segment using each of a plurality of different TSM compression ratios. Such estimates may then be provided to TSM compression ratio selector 314 and used to select the TSM compression ratio for application to the segment. For example, in an embodiment in which some form of SOLA-based TSM compression is used, one approach to determining such an estimate would be to define a speech quality metric that at least depends on a waveform similarity measure such as the well-known normalized correlation function or a waveform difference measure such as the well-known average magnitude difference function (AMDF). Such a speech quality metric could be measured over the overlap-add (OLA) region of the TSM compression operations that would be performed during application of each of the different TSM compression ratios.

In a still further embodiment, input speech signal analyzer 312 may analyze a segment to estimate an amount of distortion that will be introduced by applying TSM compression to the segment using each of a plurality of different TSM compression ratios and applying TSM decompression to each of the TSM-compressed segments using a corresponding TSM decompression ratio. For example, a segment could be analyzed by applying TSM compression to the segment using a compression ratio of 2, thereby producing a TSM-compressed segment that is one half the size of the original segment, and then applying TSM decompression to the TSM-compressed segment using a decompression ratio of 1/2 to produce a TSM-decompressed segment that is the same size as the original segment. The TSM-decompressed segment may then be compared to the original segment to determine how much distortion was introduced by the TSM compression/decompression process. Such a measure of distortion may be calculated for a variety of different compression/decompression ratio pairs and then used by TSM compression ratio selector 314 to select a TSM compression ratio.

As will be appreciated by persons skilled in the relevant art(s), any combination of the foregoing approaches may be implemented to generate information that can be used by TSM compression ratio selector 314 to determine which of a plurality of TSM compression ratios should be applied to each segment of the input speech signal. Additional approaches other than those described herein may also be used.

TSM compression ratio selector 314 receives the information generated by input speech signal analyzer 312 for each segment of the input speech signal and selects one of a plurality of different TSM compression ratios for the segment based at least on the received information. TSM compression ratio selector 314 provides the selected TSM compression ratio to TSM compressor 316 and also provides the selected TSM compression ratio, or information from which the selected TSM compression ratio can be determined or derived, to speech encoder 304.

TSM compressor 316 receives a segment of the input speech signal from input speech signal analyzer 312 and a selected TSM compression ratio for the segment from TSM compression ratio selector 314 and applies TSM compression to the segment using the selected TSM compression ratio. As noted above, in one embodiment, a DSOLA-based TSM compression algorithm such as that described in U.S. Patent Application Publication No. 2007/0094031 and in U.S. Patent Application Publication 2008/0304678 is utilized. In accordance with such an implementation, the DSOLA-based TSM compression algorithm may be applied in a manner that generates TSM-compressed segments of a fixed size, regardless of the TSM compression ratio that is selected. Borrowing the symbols and terminology used in those patent applications, this may be achieved by fixing the "Size of Synthesis frame" (SS) but allowing the "Size of Analysis frame" (SA) to change, wherein the TSM compression ratio is equal to SA/SS. Each TSM-compressed segment generated by TSM compressor 316 is passed to speech encoder 304 as part of a TSM-compressed speech signal.

Speech encoder 304 receives each TSM-compressed speech segment produced by TSM compressor 316 and encodes the TSM-compressed speech segment in accordance with a speech encoding algorithm to produce an encoded TSM-compressed speech segment. As part of the encoding process, speech encoder 304 encodes the TSM compression ratio information received from TSM compression ratio selector 314 that indicates which TSM compression ratio was used to perform TSM compression on the segment. As will be described herein, this information will be used at the decoder side to determine an appropriate TSM decompression ratio to use for applying TSM decompression to a decoded version of the encoded TSM-compressed segment.

Figure 4:
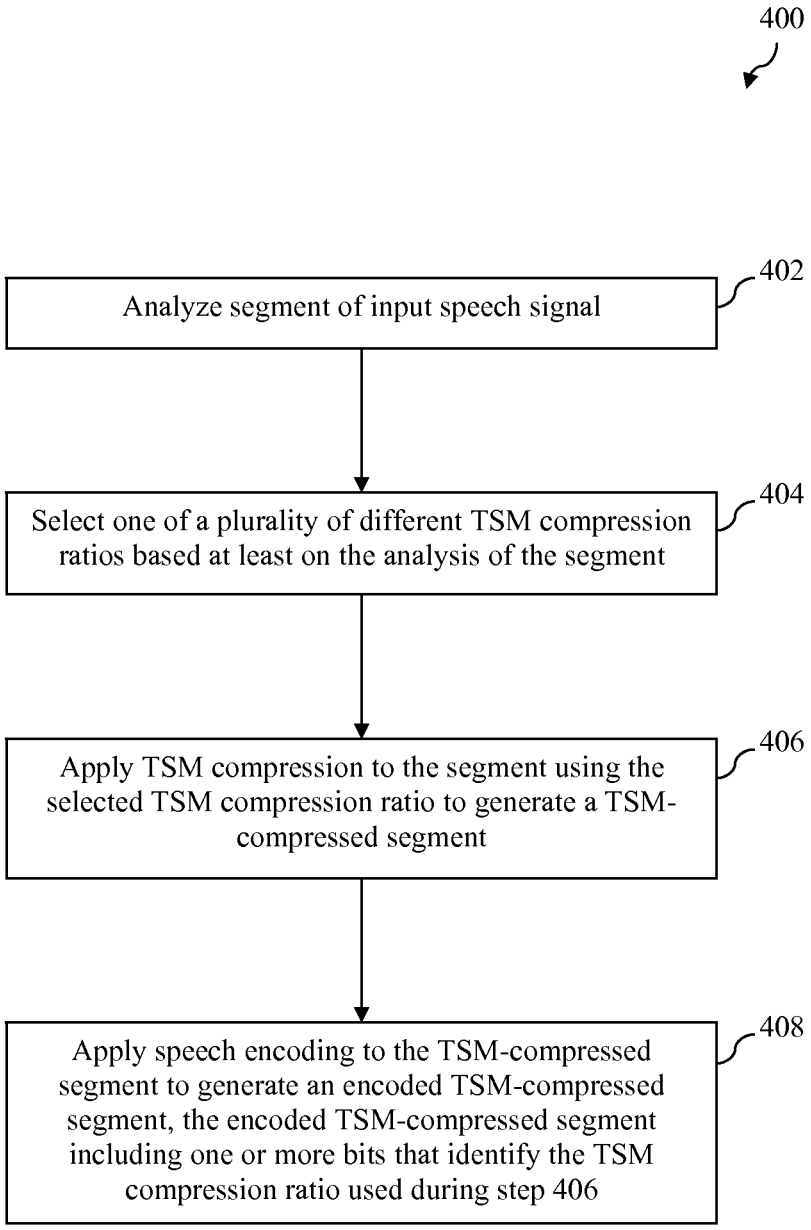
FIG. 4 depicts a flowchart of a method for generating an encoded representation of an input speech signal that utilizes dynamic TSM compression to reduce the encoding bit rate in accordance with an embodiment of the present invention.

FIG. 4 depicts a flowchart 400 of one method for generating an encoded representation of an input speech signal that utilizes dynamic TSM compression to reduce the encoding bit rate in accordance with an embodiment of the present invention. The method of flowchart 400 may be implemented, for example, by the components of system 300 as described above in reference to FIG. 3, although the method may be implemented by other systems and components as well.

As shown in FIG. 4, the method of flowchart 400 begins at step 402 in which a segment of the input speech signal is analyzed. This step may be performed, for example, by input speech signal analyzer 312 of dynamic TSM compressor 302 as described above in reference to FIG. 3. As noted above, this step may also include analyzing one or more segments that precede the segment in the input speech signal and/or analyzing one or more segments that follow the segment in the input speech signal.

At step 404, one of a plurality of different TSM compression ratios is selected based at least on the analysis of the segment performed during step 402. This step may be performed, for example, by TSM compression ratio selector 314 of dynamic TSM compressor 302 as described above in reference to FIG. 3. Depending upon the nature of the analysis performed during step 402, the selection may be based on a variety of factors. Generally speaking, the selection will be based on local characteristics of the input speech signal. In one embodiment, the selection is based at least in part on a categorization of the segment based on local characteristics of the input speech signal as one of silence, unvoiced speech, stationary voiced speech or non-stationary voiced speech. In another embodiment, the selection is based at least in part on an estimated amount of distortion that will be introduced by applying TSM compression to the segment using the selected TSM compression ratio. In a further embodiment, the selection is based at least in part on an estimated amount of distortion that will be introduced by applying TSM compression to the segment using the selected TSM compression ratio and by applying TSM decompression to the TSM-compressed segment using a TSM decompression ratio that corresponds to the selected TSM compression ratio.

At step 406, TSM compression is applied to the segment using the TSM compression ratio that was selected during step 404 to generate a TSM-compressed segment. This step may be performed, for example, by TSM compressor 316 of dynamic TSM compressor 302 as described above in reference to FIG. 3.

At step 408, speech encoding is applied to the TSM-compressed segment to generate an encoded TSM-compressed segment, the encoded TSM-compressed segment including one or more bits that identify the TSM compression ratio used during step 406. This step may be performed, for example, by speech encoder 304 as described above in reference to FIG. 3. In accordance with such an implementation, the generation of the one or more bits that identify the TSM compression ratio may be performed based on TSM compression ratio information received from TSM compression ratio selector 314 of dynamic TSM compressor 302. The speech encoding may otherwise be performed in any accordance with any previously-known or subsequently developed speech encoding technique.

Figure 5:
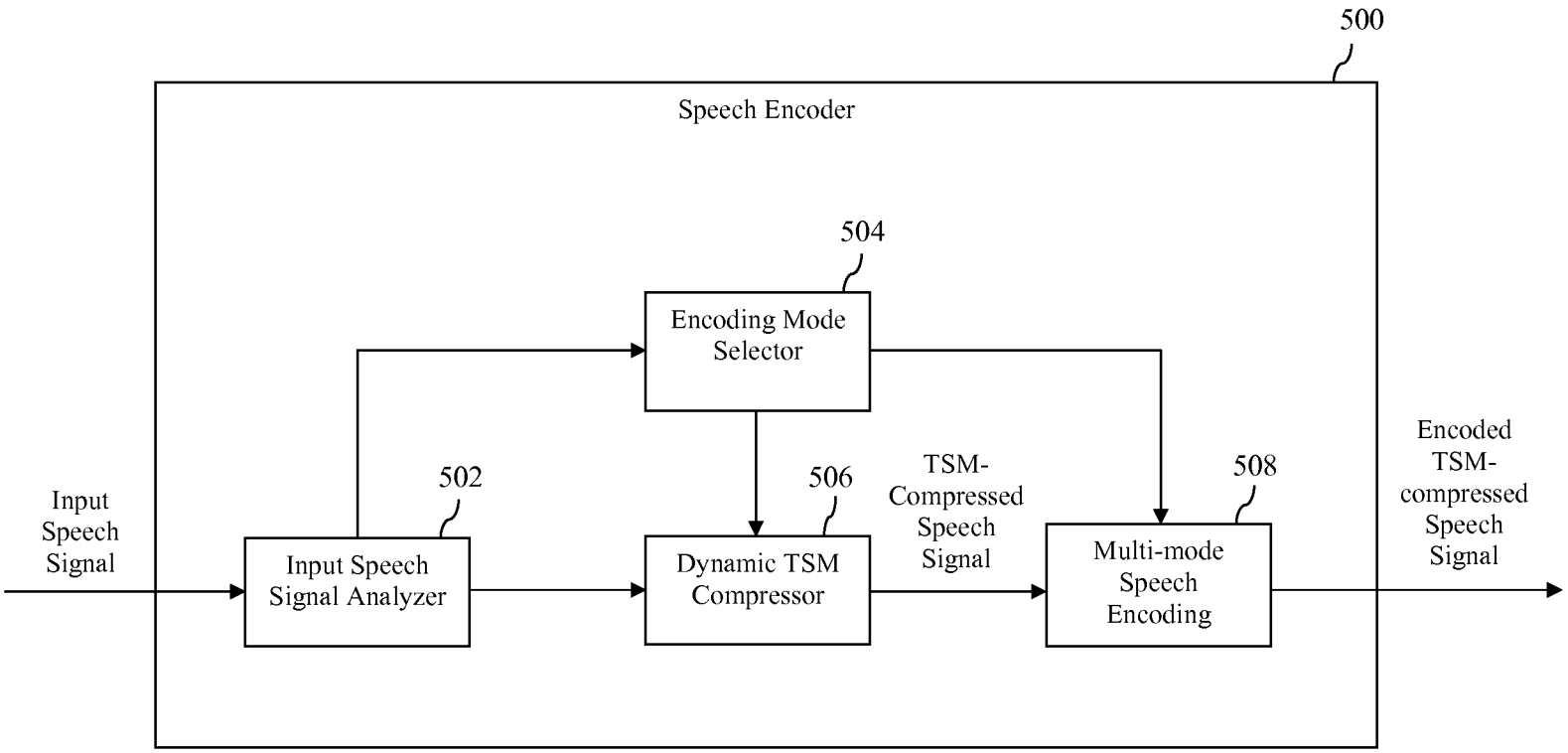
FIG. 5 is a block diagram of an example speech encoder that applies dynamic TSM compression and speech encoding to an input speech signal in accordance with an alternate embodiment of the present invention.

FIG. 5 is a block diagram of an example speech encoder 500 that applies dynamic TSM compression and speech encoding to an input speech signal in accordance with an alternate embodiment of the present invention. In contrast to system 300 of FIG. 3 in which TSM compression and speech encoding are performed by separate blocks, speech encoder 500 represents a more integrated approach to performing these operations. In particular, in speech encoder 500, an analysis of local characteristics of the input speech signal is used to drive an encoding mode decision, which in turn drives a TSM compression ratio decision. Speech encoder 500 may be used to perform the operations of dynamic TSM compressor 102 and speech encoder 104 as described above in reference to system 100 of FIG. 1 or to perform the operations of dynamic TSM compressor 202 and speech encoder 204 as described above in reference to system 200 of FIG. 2. However, these are only examples and speech encoder 500 may be used in other systems as well.

As shown in FIG. 5, speech encoder 500 includes a plurality of interconnected components including an input speech signal analyzer 502, an encoding mode selector 504, a dynamic TSM compressor 506 and a multi-mode speech encoding module 508. As will be appreciated by persons skilled in the relevant art(s), each of these components may be implemented in software, through the execution of instructions by one or more general-purpose or special-purpose processors, in hardware, using analog and/or digital circuits, or as a combination of software and hardware.

Input speech signal analyzer 502 is configured to receive the input speech signal and to analyze local characteristics associated therewith to generate information that can be used by encoding mode selector 504 to determine which of a plurality of encoding modes should be applied to each segment of the input speech signal. In generating such information, input speech signal analyzer 502 may analyze the segment for which the encoding mode is being selected, one or more segments that precede that segment, one or more segments that follow that segment, or any combination thereof.

In one embodiment, input speech signal analyzer 502 analyzes local characteristics of the input speech signal to generate information that is used by encoding mode selector 504 to classify the segment as one of silence, unvoiced speech, stationary voiced speech and non-stationary voiced speech. Based on the classification, encoding mode selector 504 then selects one of four different encoding modes corresponding to each of the different classes.

Dynamic TSM compressor 506 receives a segment of the input speech signal from input speech signal analyzer 502 and a selected encoding mode for the segment from encoding mode selector 504. Based on the selected encoding mode, dynamic TSM compressor 506 selects one of a plurality of different TSM compression ratios. For example, in one embodiment, dynamic TSM compressor 506 selects a TSM compression ratio of 2 when the selected encoding mode is the mode associated with silence segments, a TSM compression ratio of 1.5 when the selected encoding mode is the mode associated with unvoiced speech segments, a TSM compression ratio of 1.5 when the selected encoding mode is the mode associated with stationary voiced speech segments, and a TSM compression ratio of 1 (i.e., no TSM compression) when the selected encoding mode is the mode associated with non-stationary voiced speech segments. However, this is just one example of a scheme for mapping the different encoding modes to TSM compression ratios and a wide variety of other schemes may be used. As noted above, it has been observed that a relatively high TSM compression ratio can be used for segments that represent silence, unvoiced speech, and stationary voiced speech without introducing significant speech distortion whereas, in contrast, non-stationary voiced speech segments tend to become noticeably distorted when too much TSM compression is applied.

After selecting a TSM compression ratio for a segment based on the selected encoding mode associated therewith, dynamic TSM compressor 506 applies TSM compression to the segment using the selected TSM compression ratio to generate a TSM-compressed segment. Each TSM-compressed segment generated by dynamic TSM compressor 506 is passed to multi-mode speech encoding module 508 as part of a TSM-compressed speech signal.

Multi-mode speech encoding module 508 receives a TSM-compressed segment of the input speech signal from dynamic TSM compressor 506 and a selected encoding mode for the segment from encoding mode selector 504. Multi-mode speech encoding module 508 applies speech encoding to the TSM-compressed segment in accordance with the selected encoding mode to generate an encoded TSM-compressed segment. In one embodiment, a different set of speech-related parameters is encoded for each encoding mode. As part of the encoding process, multi-mode speech encoding module 508 encodes one or more bits that uniquely identify the encoding mode that was used to encode the segment. Since each encoding mode is associated with a particular TSM compression ratio as discussed above, the encoding mode bit(s) may likewise be used to determine the TSM compression ratio that was applied to each encoded TSM-compressed segment. As will be described herein, the encoding mode bit(s) may be used at the decoder side to determine both an appropriate decoding mode and an appropriate TSM decompression ratio for use in applying TSM decompression to a decoded version of the encoded TSM-compressed segment.

Since, in the embodiment shown in FIG. 5, the encoding mode decision drives the selection of the TSM compression ratio, input speech signal analyzer 502 may be configured to generate information that can help determine the extent to which a segment can be TSM-compressed without introducing significant speech distortion and encoding mode selector 504 may be configured to use such information in rendering an encoding mode decision. As noted above in reference to other embodiments, such information may include an estimate of an amount of distortion that will be introduced by applying TSM compression to the segment using each of a plurality of different TSM compression ratios or an estimate of an amount of distortion that will be introduced by applying TSM compression to the segment using each of a plurality of different TSM compression ratios and applying TSM decompression to each of the TSM-compressed segments using a corresponding TSM decompression ratio.

Figure 6:
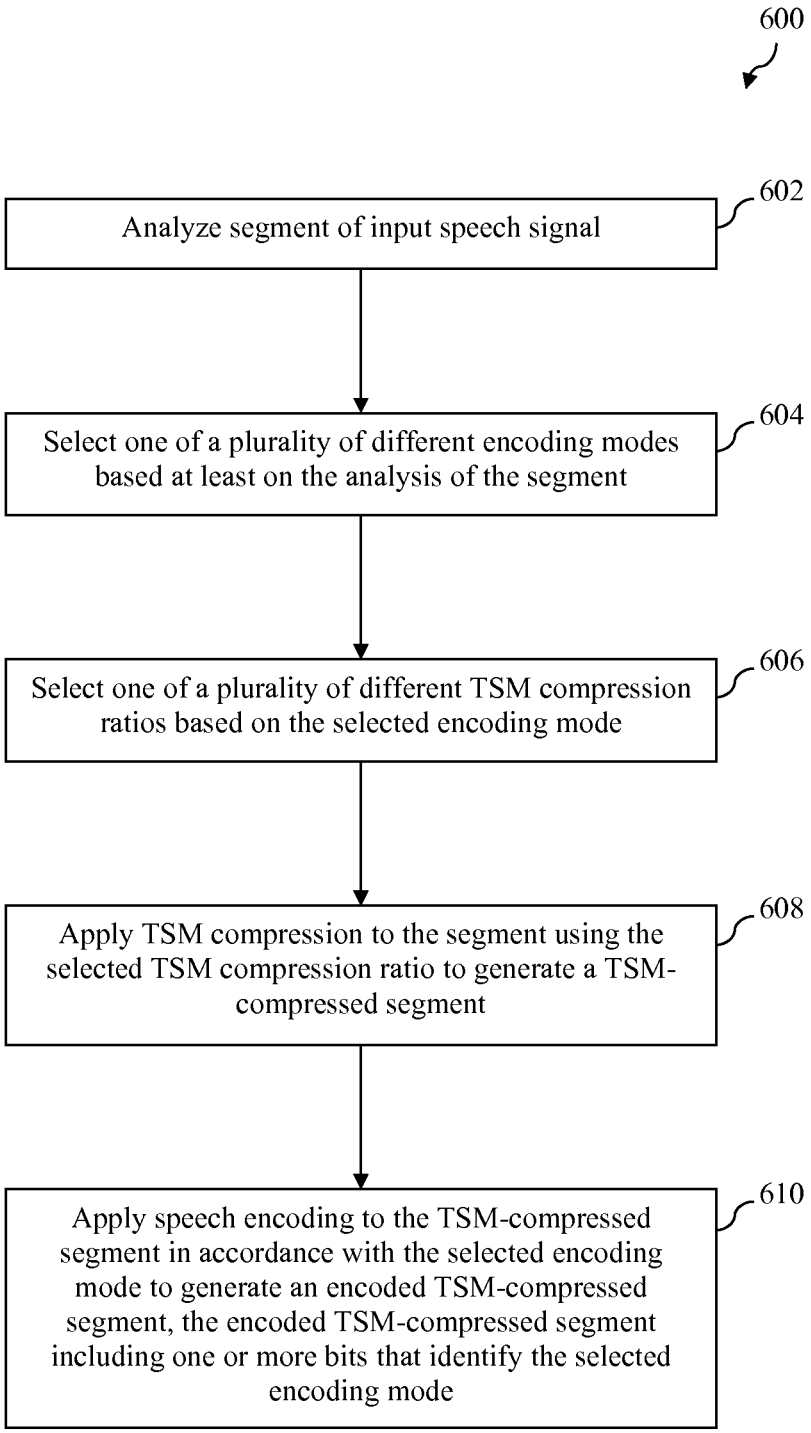
FIG. 6 depicts a flowchart of a method for generating an encoded representation of an input speech signal that utilizes dynamic TSM compression to reduce the encoding bit rate in accordance with an alternate embodiment of the present invention.

FIG. 6 depicts a flowchart 600 of a method for generating an encoded representation of an input speech signal that utilizes dynamic TSM compression to reduce the encoding bit rate in accordance with an alternate embodiment of the present invention. The method of flowchart 600 may be implemented, for example, by speech encoder 500 as described above in reference to FIG. 6, although the method may be implemented by other systems and components as well.

As shown in FIG. 6, the method of flowchart 600 begins at step 602 in which a segment of the input speech signal is analyzed. This step may be performed, for example, by input speech signal analyzer 502 of speech encoder 500 as described above in reference to FIG. 5. As noted above, this step may comprise analyzing the segment alone, analyzing one or more segments that precede the segment in the input speech signal, analyzing one or more segments that follow in the input speech signal, or any combination thereof.

At step 604, one of a plurality of different encoding modes is selected based on at least the analysis of the segment performed during step 602. This step may be performed, for example, by encoding mode selector 504 of speech encoder 500 as described above in reference to FIG. 5. In one embodiment, this step comprises selecting one of an encoding mode for silence segments, an encoding mode for unvoiced speech segments, an encoding mode for stationary voiced speech segments and an encoding mode for non-stationary voiced speech segments.

Depending upon the nature of the analysis performed during step 602, the selection of the encoding mode may be based on a variety of factors. Generally speaking, the selection will be based on local characteristics of the input speech signal. In certain embodiments, the selection may be based at least in part on an estimated amount of distortion that will be introduced by applying TSM compression to the segment using a TSM compression ratio associated with the selected encoding mode. In further embodiments, the selection may be based at least in part on an estimated amount of distortion that will be introduced by applying TSM compression to the segment using a TSM compression ratio associated with the selected encoding mode and by applying TSM decompression to the TSM-compressed segment using a TSM decompression ratio that corresponds to the TSM compression ratio associated with the selected encoding mode.

At step 606, one of a plurality of different TSM compression ratios is selected based on the encoding mode that was selected during step 604. This step may be performed, for example, by dynamic TSM compressor 506 of encoder 500 as described above in reference to FIG. 5. In one particular embodiment, this step comprises selecting a greater TSM compression ratio for one of a silence, unvoiced speech, or stationary voiced speech encoding mode than a TSM compression ratio that would be selected for a non-stationary voiced speech encoding mode. In a further embodiment, this step comprises selecting a greater TSM compression ratio for a silence encoding mode than a TSM compression ratio that would selected for an unvoiced speech or stationary voiced speech encoding mode.

At step 608, TSM compression is applied to the segment using the TSM compression ratio that was selected during step 608 to generate a TSM-compressed segment. This step may be performed, for example, by dynamic TSM compressor 506 of speech encoder 500 as described above in reference to FIG. 5.

At step 610, speech encoding is applied to the TSM-compressed segment in accordance with the selected encoding mode to generate an encoded TSM-compressed segment, the encoded TSM-compressed segment including one or more bits that identify the encoding mode that was selected during step 604. This step may be performed, for example, by multi-mode speech encoding module 508 of speech encoder 500 as described above in reference to FIG. 5.

Figure 7:
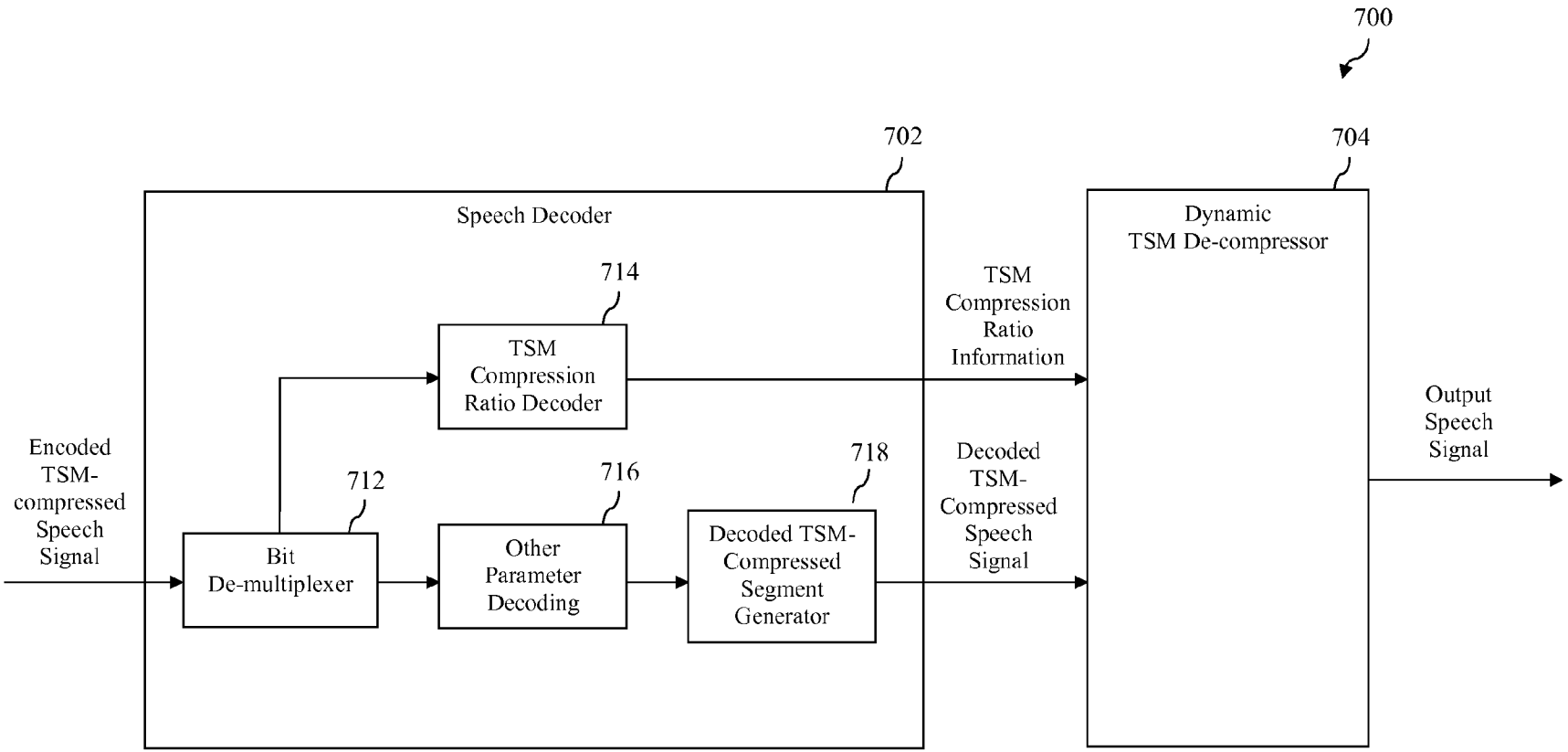
FIG. 7 is a block diagram of an example system that applies speech decoding and dynamic TSM decompression to an encoded TSM-compressed speech signal in accordance with an embodiment of the present invention.

D. Example Decoder/Dynamic TSM De-compressor in Accordance with Embodiments of the Present Invention FIG. 7 is a block diagram of an example system 700 that applies speech decoding and dynamic TSM decompression to an encoded TSM-compressed speech signal in accordance with an embodiment of the present invention. As shown in FIG. 7, system 700 includes a speech decoder 702 and a dynamic TSM de-compressor 704. Speech decoder 702 and dynamic TSM de-compressor 704 may represent an implementation of speech decoder 108 and dynamic TSM de-compressor 110 as described above in reference to system 100 of FIG. 1 or speech decoder 208 and dynamic TSM de-compressor 210 as described above in reference to system 200 of FIG. 2. However, these are only examples and speech decoder 702 and dynamic TSM de-compressor 704 may be used in other systems as well.

As will be appreciated by persons skilled in the relevant art(s), each of speech decoder 702 and dynamic TSM de-compressor 704, as well as any sub-components thereof, may be implemented in software, through the execution of instructions by one or more general purpose or special-purpose processors, in hardware, using analog and/or digital circuits, or as a combination of software and hardware.

Generally speaking, speech decoder 702 is configured to receive an encoded TSM-compressed speech signal and to apply speech decoding thereto to generate a decoded TSM-compressed speech signal. As shown in FIG. 7, speech decoder 702 includes a plurality of interconnected components, including a bit de-multiplexer 712, a TSM compression ratio decoder 714, an other parameter decoding module 716, and a decoded TSM-compressed segment generator 718. Each of these components will now be described.

Bit de-multiplexer 712 operates to receive an encoded TSM-compressed segment of a speech signal and to extract a set of encoded parameters therefrom. In particular, bit de-multiplexer 712 extracts an encoded parameter representative of a TSM compression ratio and provides the parameter to TSM compression ratio decoder 714. Bit de-multiplexer 712 also extracts a number of other encoded parameters and provides the other encoded parameters to other parameter decoding module 716.

TSM compression ratio decoder 714 receives the encoded parameter representative of the TSM compression ratio and decodes it to generate TSM compression ratio information which is provided to dynamic TSM de-compressor 704.

Other parameter decoding module 716 is configured to receive all the other encoded parameters associated with the segment and to decode the parameters in accordance with a particular speech decoding scheme implemented by speech decoder 702. As will be appreciated by persons skilled in the relevant art(s), the structure, function and operation of other parameter decoding module 716 will vary depending upon the codec design. In an example implementation in which speech decoder 702 comprises a modified version of a BV16 or BV32 decoder, other parameter decoding module 716 may operate to decode encoded parameters that include encoded representations of LSP parameters, a pitch period, three pitch taps, an excitation gain and excitation vectors associated with each 5 ms frame of a speech signal. The decoded parameters generated by other parameter decoding module 716 are provided to decoded TSM-compressed segment generator 718.

Decoded TSM-compressed segment generator 718 is configured to receive a set of decoded parameters from other parameter decoding module 716 and to use the decoded parameters to generate a corresponding decoded TSM-compressed segment. Each decoded TSM-compressed segment generated by decoded TSM-compressed segment generator 718 in this fashion is output to dynamic TSM de-compressor 704 as part of a decoded TSM-compressed speech signal.

Dynamic TSM de-compressor 704 is configured to receive each segment of the decoded TSM-compressed speech signal from decoded TSM-compressed segment generator 718 as well as TSM compression ratio information associated with each segment from TSM compression ratio decoder 714. Based on the TSM compression ratio information associated with a segment, dynamic TSM de-compressor 704 selects one of a plurality of different TSM decompression ratios. Dynamic TSM de-compressor 704 then applies TSM decompression to the decoded TSM-compressed segment using the selected decompression ratio to produce a decoded TSM-decompressed segment. Each decoded TSM-decompressed segment produced by dynamic TSM de-compressor in this manner is output as part of an output speech signal. Depending upon the application, the output speech signal may be played back to a user, further processed for playback to a user, transmitted to another entity, etc.

As noted above, in one embodiment, a DSOLA-based TSM decompression algorithm such as that described in U.S. Patent Application Publication No. 2007/0094031 and in U.S. Patent Application Publication 2008/0304678 is used to perform TSM de-compression. In accordance with such an implementation, the DSOLA-based TSM decompression algorithm may be applied in such a manner that TSM-compressed segments of a fixed size are operated upon to produce TSM-decompressed segments of a variable size. Borrowing the symbols and terminology used in those patent applications, this may be achieved by fixing the "Size of Analysis frame" (SA) but allowing the "Size of Synthesis frame" (SS) to change, wherein the TSM decompression ratio is equal to SA/SS.

Figure 8:
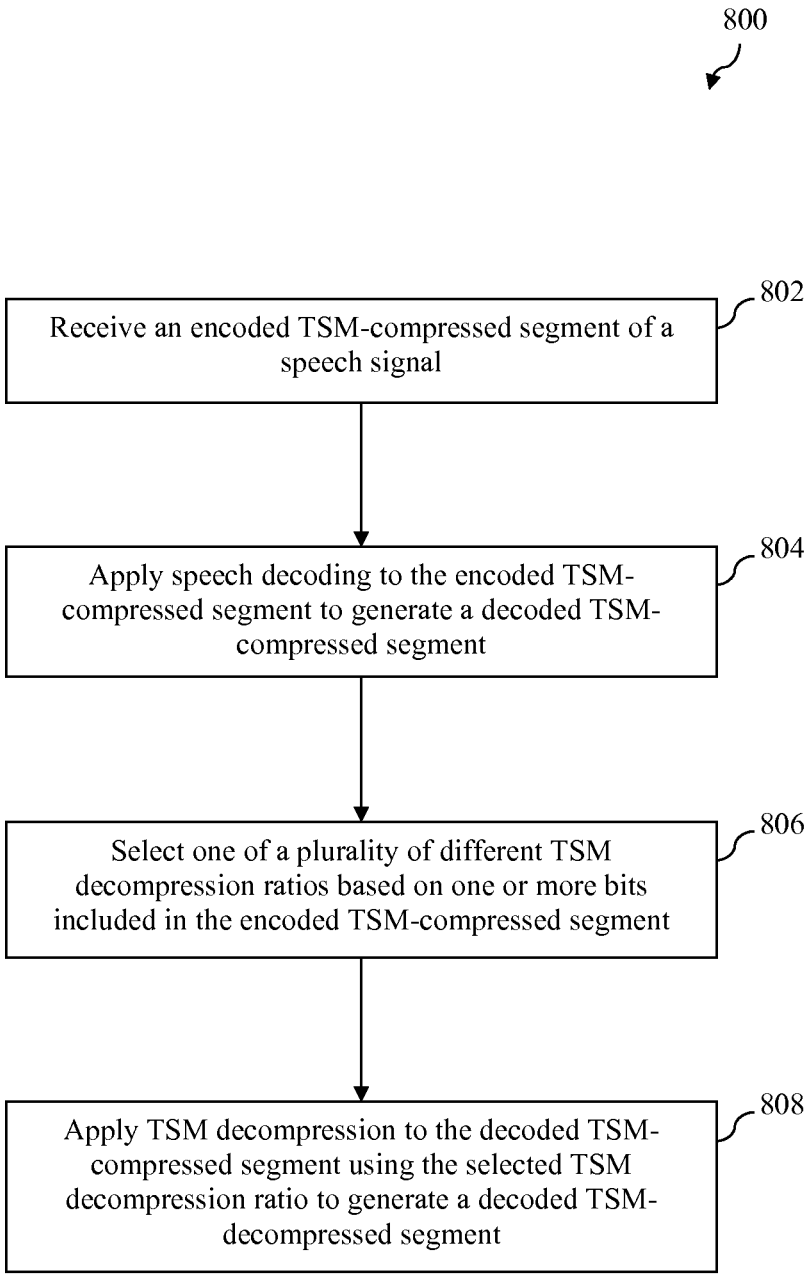
FIG. 8 depicts a flowchart of a method for decoding an encoded representation of a speech signal that utilizes dynamic TSM decompression to reduce a coding bit rate in accordance with an embodiment of the present invention.

FIG. 8 depicts a flowchart 800 of one method for decoding an encoded representation of a speech signal that utilizes dynamic TSM decompression to reduce a coding bit rate in accordance with an embodiment of the present invention. The method of flowchart 800 may be implemented, for example, by the components of system 700 of FIG. 7, although the method may be implemented by other systems and components as well.

As shown in FIG. 8, the method of flowchart 800 begins at step 802 in which an encoded TSM-compressed segment of a speech signal is received. This step may be performed, for example, by bit de-multiplexer 712 of speech decoder 702 as described above in reference to FIG. 7.

At step 804, speech decoding is applied to the encoded TSM-compressed segment to generate a decoded TSM-compressed segment. This step may be performed, for example, by bit de-multiplexer 712, other parameter decoding module 716, and decoded TSM-compressed segment generator 718 of speech decoder 702 as described above in reference to FIG. 7.

At step 806, one of a plurality of different TSM decompression ratios is selected based on one or more bits included in the encoded TSM-compressed segment. This step may be performed, for example, by TSM compression ratio decoder 714 of speech decoder 702 which receives and decodes one or more bits included in the encoded TSM-compressed segment to obtain TSM compression ratio information associated with the segment and by dynamic TSM de-compressor 704, which uses the obtained TSM compression ratio information to select one of a plurality of different TSM decompression ratios.

At step 808, TSM decompression is applied to the decoded TSM-compressed segment using the TSM decompression ratio that was selected during step 806 to generate a decoded TSM-decompressed segment. The decoded TSM-decompressed segment may be provided as part of an output speech signal that is played back to a user, further processed for playback to a user, transmitted to another entity, etc.

FIG. 9 is a block diagram of an example speech decoder 900 that that applies speech decoding and dynamic TSM decompression to an encoded TSM-compressed speech signal in accordance with an alternate embodiment of the present invention. In contrast to system 700 of FIG. 7 in which speech decoding and TSM decompression are performed by separate blocks, speech decoder 900 represents a more integrated approach to performing these operations. In particular, in speech decoder 900, the value of one or more mode bits provided as part of an encoded TSM-compressed segment is used to drive a decoding mode decision, which in turn drives a TSM decompression ratio decision. Speech decoder 900 may be used to perform the operations of speech decoder 108 and dynamic TSM de-compressor 110 as described above in reference to system 100 of FIG. 1 or to perform the operations of speech decoder 208 and dynamic TSM de-compressor 210 as described above in reference to system 200 of FIG. 2. However, these are only examples and speech decoder 900 may be used in other systems as well.

As shown in FIG. 9, speech decoder 900 includes a plurality of interconnected components including a bit de-multiplexer 902, a decoding mode selector 904, a multi-mode decoder 906 and a dynamic TSM de-compressor 908. As will be appreciated by persons skilled in the relevant art(s), each of these components may be implemented in software, through the execution of instructions by one or more general purpose or special-purpose processors, in hardware, using analog and/or digital circuits, or as a combination of software and hardware.

Bit de-multiplexer 902 operates to receive an encoded TSM-compressed segment of a speech signal and to extract a set of encoded parameters therefrom. In particular, bit de-multiplexer 902 extracts one or more mode bits and provides the mode bit(s) to decoding mode selector 904. Bit de-multiplexer 902 also extracts a number of other encoded parameters associated with the segment and provides the other encoded parameters to multi-mode decoder 906.

Decoding mode selector 904 is configured to select one of a plurality of different decoding modes for the segment based on the mode bit(s) received from bit de-multiplexer 902. In one embodiment, depending on the value of the mode bit(s), decoding mode selector 904 selects one of a decoding mode for silence segments, a decoding mode for unvoiced speech segments, a decoding mode for stationary voiced speech segments, and a decoding mode for non-stationary voiced speech segments.

Multi-mode decoder 906 is configured to receive the set of encoded parameters associated with the segment from bit de-multiplexer 902 and to decode the encoded parameters in accordance with the decoding mode selected for the segment by decoding mode selector 904. Multi-mode decoder 906 is further configured to use the set of decoded parameters to generate a decoded TSM-compressed segment. Decoded TSM-compressed segments generated by multi-mode decoder 906 in this manner are output to dynamic TSM de-compressor 908 as part of a decoded TSM-compressed speech signal.

Dynamic TSM de-compressor 908 is configured to receive the selected decoding mode from decoding mode selector 904, and based on the selected decoding mode, to select one of a plurality of different TSM decompression ratios. For example, in one embodiment, dynamic TSM de-compressor 908 selects a TSM decompression ratio of 0.5 when the selected decoding mode is the mode associated with silence segments, a TSM decompression ratio of 2/3 when the selected decoding mode is the mode associated with unvoiced speech segments, a TSM compression ratio of 2/3 when the selected decoding mode is the mode associated with stationary voiced speech segments, and a TSM decompression ratio of 1 (i.e., no TSM decompression) when the selected decoding mode is the mode associated with non-stationary voiced speech segments. However, this is just one example of a scheme for mapping the different decoding modes to TSM decompression ratios and a wide variety of other schemes may be used.

After selecting a TSM decompression ratio for a decoded TSM-compressed segment based on the selected decoding mode associated therewith, dynamic TSM de-compressor 908 applies TSM decompression to the segment using the selected TSM decompression ratio to generate a decoded TSM-decompressed segment. Each decoded TSM-decompressed segment generated by dynamic TSM de-compressor 908 is output by speech decoder 900 as part of an output speech signal. Depending upon the application, the output speech signal may be played back to a user, further processed for playback to a user, transmitted to another entity, etc.

FIG. 10 depicts a flowchart 1000 of a method for decoding an encoded representation of a speech signal that utilizes dynamic TSM decompression to reduce a coding bit rate in accordance with an alternate embodiment of the present invention. The method of flowchart 1000 may be implemented, for example, by speech decoder 900 of FIG. 9, although the method may be implemented by other systems and components as well.

As shown in FIG. 10, the method of flowchart 1000 begins at step 1002 in which an encoded TSM-compressed segment of a speech signal is received. This step may be performed, for example, by bit de-multiplexer 902 of speech decoder 900 as described above in reference to FIG. 9.

At step 1004, one of a plurality of different decoding modes is selected based on one or more bits included in the encoded TSM-compressed segment. This step may be performed, for example, by decoding mode selector 904 of speech decoder 900 as described above in reference to FIG. 9. In one embodiment, selecting one of the plurality of different decoding modes comprises selecting one of a decoding mode for silence segments, a decoding mode for unvoiced speech segments, a decoding mode for stationary voiced speech segments and a decoding mode for non-stationary voiced speech segments.

At step 1006, speech decoding is applied to the encoded TSM-compressed segment in accordance with the decoding mode selected during step 1004 to generate a decoded TSM-compressed segment. This step may be performed, for example, by multi-mode decoder 906 of speech decoder 900 as described above in reference to FIG. 9.

At step 1008, one of a plurality of different TSM decompression ratios is selected based on the decoding mode that was selected during step 1004. This step may be performed, for example, by dynamic TSM de-compressor 908 of speech decoder 900 as described above in reference to FIG. 9.

At step 1010, TSM decompression is applied to the decoded TSM-compressed segment generated during step 1006 using the TSM decompression ratio selected during step 1008 to generate a decoded TSM-decompressed segment. This step may also be performed, for example, by dynamic TSM de-compressor 908 of speech decoder 900 as described above in reference to FIG. 9. The decoded TSM-decompressed segment may be provided as part of an output speech signal that is played back to a user, further processed for playback to a user, transmitted to another entity, etc.

E. Implementation Considerations for Systems Utilizing Dynamic TSM for Reduced Bit Rate Audio Coding 1. Segment Size Considerations As noted above, in certain embodiments, a DSOLA or other overlap-add-based TSM algorithm may be used to perform TSM compression and decompression operations. As further noted above, in certain ones of these embodiments, TSM compression is used to produce compressed segments of a fixed size. To achieve good speech quality after TSM compression and subsequent decompression, the fixed segment size of the overlap-add-based TSM algorithm in the TSM-compressed time domain needs to be chosen properly. If the fixed segment size is too large, the output speech after TSM compression and decompression will tend to have warbly distortion. On the other hand, if the fixed segment size is too small, not only will the computational complexity be higher, but the output speech will also tend to have a slight high-frequency ringing distortion, perhaps due to too many overlap-add operations performed on each speech sample. To obtain good speech quality without these two kinds of distortion described above, the fixed segment size in the TSM-compressed time domain should be roughly comparable to the average pitch period of the input speech signal. Even better speech quality can be achieved by using an adaptive segment size in the TSM-compressed time domain, where the adaptive segment size is driven by and is roughly equal to the local pitch period of the input speech signal.

2. Waveform Spike Duplication

It has been observed that one common and annoying artifact produced during TSM decompression using overlap-add-based algorithms (such as SOLA, DSOLA, etc.) is the duplication of isolated waveform spikes, such as the pulse-like waveforms of plosive consonants (/p/, /t/, etc.). When this happens, that part of the speech signal sounds slightly buzzy and doesn't sound natural. To improve the output speech quality after TSM compression and subsequent TSM decompression, it is therefore desirable to eliminate such waveform spike duplication. Through in-depth investigation, it was found that there are multiple complicated mechanisms that can lead to such waveform spike duplication, and it is not an easy matter to eliminate such spike duplication. After detailed analysis, a solution was found that can eliminate such spike duplication. It is described below based on the algorithm description of DSOLA as given in U.S. Patent Application Publication No. 2007/0094031 to Chen (filed Oct. 20, 2006) and in U.S. Patent Application Publication 2008/0304678 to Chen et al. (filed May 12, 2008), mentioned above.

Borrowing the symbols and terminology used in U.S. Patent Application Publication Nos. 2007/0094031 and 2008/0304678, let SA be the size of the analysis frame, SS be the size of the synthesis frame, WS be the window size of the sliding window used in the search for the optimal time shift for overlap-add, which is also the overlap-add window size. Also, let x(k) be the input signal buffer, y(k) be the output signal buffer before the time-shift search and the overlap-add operation, and y'(k) be the output signal buffer after the overlap-add operation, where k is the sample index within the buffers. Normally, the optimal time shift kopt has a range of 0 to L samples.

One condition that causes the waveform spike duplication to happen is when the waveform spike is in the first SA samples of the input signal buffer x(k) and the same waveform spike appears earlier in the output signal buffer y(k) before overlap-add. In this case, the ideal time shift to align the waveform spikes in x(k) and y(k) would need to be negative, but since kopt is constrained to be non-negative, the time shift search will miss the true alignment and will find a positive time shift that will cause the waveform spike in the input buffer to be overlap-added to a section of the waveform in the output buffer that is after the earlier waveform spike already in the output buffer. A duplication of the spike therefore results.

To prevent such a condition from happening, one needs to make sure that the waveform spike in the output buffer y(k) is not earlier than the corresponding waveform spike in the input buffer x(k). Let $I_x(n)$ and $I_y(n)$ be the time indices of the starting points of the waveform spikes at the n-th frame in the input buffer x(k) and the output buffer y(k) before overlap-add, respectively. Similarly, let $I_{y'}(n-1)$ be the time index of the starting point of the corresponding waveform spike in the output buffer y'(k) of the (n−1)-th frame after overlap-add. To prevent spike duplication, the requirement is that $$I_y(n) \geq I_x(n), \text{ when } 0 \leq I_x(n) < SA. \tag{1}$$

Now one needs to trace the waveform spike backward in time to determine what kinds of conditions need to be satisfied during the DSOLA processing of the previous frames in order for the requirement in (1) above to hold. Note that the y(k) buffer of the n-th frame is essentially the y'(k) buffer of the (n−1)-th frame shifted by SS samples, and the x(k) buffer of the n-th frame is essentially the x(k) buffer of the (n-1)-th frame shifted by SA samples. Mathematically, this means $$I_y(n) = I_{y'}(n-1) - SS, \tag{2}$$

and $$I_x(n) = I_x(n-1) - SA. \tag{3}$$

Thus, the requirement in (1) above is equivalent to $$I_{y'}(n-1) - SS \geq I_n(n-1) - Sa, \text{ when } 0 < I_x(n-1) - SA \leq SA, \tag{4}$$

which is equivalent to $$I_{y'}(n-1) - I_x(n-1) \geq SS - SA, \text{ when } SA < I_x(n-1) \leq 2SA, \tag{5}$$

If the window size WS is chosen to be the same as SA, then during the (n−1)-th frame, $SA < I_x(n-1) \leq 2SA$ means the waveform spike was not part of the first WS samples of the input buffer x(k), which was used as the target template for waveform matching in the search for the optimal time shift. This means that after the optimal time shift kopt(n−1) for the (n−1)-th frame is found and the first WS samples of the input buffer, or x(1:WS) is overlap-added with y(kopt(n−1)+1:kopt(n−1)+WS), the waveform spike in the input buffer after x(WS) is simply copied over to the portion of the output buffer after y(kopt(n−1)+WS). The resulting output buffer after such overlap-add and copying operations is the y'(k) buffer, and the copying operation means the waveform spike in the x(k) buffer is delayed by exactly kopt samples as it was copied to the y'(k) buffer. This means that $$I_{y'}(n-1) = I_x(n-1) + \text{kopt}(n-1), \tag{6}$$

or $$I_{y'}(n-1) - I_x(n-1) = \text{kopt}(n-1). \tag{7}$$

Plugging (7) back into (5), one obtains the following condition that needs to be met in the (n−1)-th frame in order to avoid waveform spike duplication in the current n-th frame.

$$\text{kopt}(n-1) \geq SS - SA, \text{ when } SA < I_x(n-1) \leq 2SA. \tag{8}$$

Although this condition above is necessary, by itself it is not sufficient to guarantee that the spike duplication will not happen. One other scenario can still cause spike duplication to happen. That is, in the (n−1)-th frame, if the waveform spike is already in y(1:WS), or the first WS samples of the output buffer before overlap-add, then since kopt(n−1)≥0 and $I_x(n-1) > SA = WS$ , there will be another waveform spike appearing after y'(kopt(n−1)+WS) after overlap-add and copying operations, thus causing waveform spike duplication in the output buffer y'(k). To prevent this from happening, one needs to make sure that the time index of the starting point of the waveform spike in the y(k) buffer before overlap-add is greater than WS, or $I_y(n-1) > WS$, and a special overlap-add operation is performed in the (n−1)-th frame to make sure such a waveform spike in the y(k) buffer does not appear in the y'(k) buffer until $I_{y'}(n-1) = I_x(n-1) + \text{kopt}(n-1)$ as derived in (6) above.

One needs to go back further to the (n−2)-th frame to see what conditions need to be met there in order to satisfy the additional condition $I_y(n-1) > WS$ above. Note that the y(k) buffer of the (n−1)-th frame is essentially the y'(k) buffer of the (n-2)-th frame shifted by SS samples, and the x(k) buffer of the (n-1)-th frame is essentially the x(k) buffer of the (n−2)-th frame shifted by SA samples. Mathematically, this means $$I_{y'}(n-2) = I_y(n-1) + SS, \tag{9}$$

and $$I_x(n-2) = I_x(n-1) + SA = I_x(n) + 2SA. \tag{10}$$

From (9) above, one can see that to meet the requirement of $I_y(n-1) > WS$, the waveform spike should appear in the y'(k) buffer of the (n-2)-th frame no earlier than the (WS+SS)-th sample. That is, $$I_{y'}(n-2) > WS + SS. \tag{11}$$

To satisfy (11), kopt(n−2), the optimal time shift at the (n−2)-th frame, needs to satisfy the following inequality $$\text{kopt}(n-2) = I_{y'}(n-2) - I_x(n-2) > WS + SS - I_x(n-2) \tag{12}$$

Note that at the very beginning of the equation derivation above, it was assumed that the starting point of the waveform spike is in the first SA samples of the input buffer x(k) of the current n-th frame. That is, it was assumed that $0 < I_x(n) \leq SA$. Hence, from (10), it then follows that $2SA < I_x(n-2) \leq 3SA$. To find the minimum threshold on kopt(n−2) that guarantees that (11) is true, one should supply the worst-case value of $I_x(n-2)$ in (12). The worst-case value of $I_x(n-2)$ is when the starting point of the waveform spike is at the earliest possible location, or when $I_x(n-2) = 2SA+1$. With this worst-case value of $I_x(n-2)$ plugged into (12), one obtains $$\text{kopt}(n-2) > WS + SS - 2SA - 1, \text{ when } 2SA < I_x(n-2) \leq 3SA \tag{13}$$

or $$\text{kopt}(n-2) \geq WS + SS - 2SA, \text{ when } 2SA < I_x(n-2) \leq 3SA \tag{14}$$

If the window size WS is chosen to be the same as SA as mentioned above, then equation (14) becomes $$\text{kopt}(n-2) \geq SS-SA, \text{ when } 2SA < I_x(n-2) \leq 3SA \quad (15)$$

Through simulations and analysis, it was found that one does not need to go back more than two frames to enforce any condition there in order to avoid waveform spike duplication in the current frame. The reason is that at the (n−3)-th frame and earlier frames, the waveform spike is so far in the future that any operation performed in those frames has no effect whatsoever on whether this waveform spike will later be duplicated. Therefore, the (n−3)-th frame and earlier frames can be totally ignored when trying to avoid the waveform duplication of the current frame.

Based on the mathematical derivation above, the special procedure to avoid waveform spike duplication is described below. Waveform spikes in the input speech need to be identified first. There are a number of ways that can be used to achieve this. As an example, peak-to-average ratio (PAR) of the speech sample magnitude within each frame can be calculated for the input speech frame-by-frame. A frame can be declared to have a waveform spike if its PAR exceeds a certain threshold. The TSM de-compressor needs to have a look ahead of two frames in order to know whether a waveform spike is in the next frame of the input speech buffer or two frames later than the current frame. The window size WS is chosen to be the same as SA.

Typically a waveform spike follows a silence frame or an unvoiced frame and it hardly ever follows a quasi-periodic voiced frame. This fact makes it somewhat easier to manipulate the optimal time shift kopt to meet the requirement specified in (8) and (15). Note that the requirements on kopt specified in (8) and (15) is not to be achieved simply by setting the optimal time shift search range to be at or greater than the threshold of (SS−SA) and then perform DSOLA operations as usual, because doing so may still result in overlap-adding with a waveform spike already in the y(k) buffer, thus still resulting in waveform spike duplication. Instead, the requirements on kopt specified in (8) and (15) should be achieved in a special way, but "extending" the waveform in the silence or unvoiced region preceding the waveform spike so that even if there is a waveform spike in the y(k) buffer right after y(WS), it will be replaced by the silence or unvoiced waveform, and the waveform spike in the input buffer x(k) is delayed by at least (SS−SA) samples when it is copied from the input buffer x(k) to the output buffer y'(k) after overlap-add.

There are multiple possible ways to do such "extension" of silence or unvoiced region. One example is to start by overlap-adding x(1:WS) with y(1:WS) after applying the fade-in window and fade-out window, respectively. The resulting full-length (WS samples) result goes into y'(1:WS). Then, multiply y'(WS/2+1:WS) by a half-length (WS/2 samples) fade-out window, multiply x(1:WS/2) by a half-length fade-in window, overlap-add the two windowed half-length segments, store the resulting half-length segment into y'(WS/2+1:WS) to overwrite it, and then extend the silence or unvoiced waveform by copying x(WS/2+1:WS) to y'(WS+1:WS+WS/2). Such an operation extends the silence or unvoiced segment by WS/2 samples. This operation can be repeated multiple times, each time shifting the operation boundaries by WS/2 samples into the future to extend by WS/2 samples each time. This process is repeated until the requirements on kopt specified in (8) and (15) can be satisfied. The number of times this process needs to be performed is $$\left\lceil \frac{(SS-SA)}{(WS/2)} \right\rceil,$$

or the smallest integer that is greater than (SS−SA)/(WS/2). After that, the remaining speech samples in the input buffer after x(WS) is copied to the y' (k) buffer after the last sample of y'(k) that is affected by the repeated overlap-add and extension operation. After such procedure is performed, the equivalent kopt is guaranteed to be no less than (SS−SA) samples, thus satisfying the requirements on kopt specified in (8) and (15) above. Note that the fixed half-a-frame shift between successive overlap-add and copying operations does not cause audible distortion for silence or unvoiced regions because the signal is either too low in intensity (silence) to be noticeable or is noise-like (unvoiced) anyway. With this example waveform extension method, the algorithm to avoid waveform spike duplication can be summarized as follows. This algorithm is represented as a flowchart 1100 in FIG. 11.

1. During decision step 1102, if the current input frame of x(1:SA) corresponds to a silence or unvoiced frame and if a waveform spike is in the next two frames of the input speech, i.e., within x(SA+1:3SA), then extend the silence or unvoiced frame x(1:SA) half a frame at a time using the method above for $$\left\lceil \frac{(SS-SA)}{(WS/2)} \right\rceil,$$

times as shown in step 1104, and then copy the waveform in x(SA+1:3SA) to fill up the rest of the y'(k) buffer as shown in step 1106. (This will delay the waveform spike within x(SA+1:3SA) by at least (SS−SA) samples in the output y'(k) buffer.)

2. Otherwise, do the usual DSOLA operation for this frame normally as shown in step 1108.

Simulation results have shown that, for certain implementations, this simple algorithm eliminated all waveform spike duplication when the waveform spike follows silence or unvoiced frames. In the extremely rare occasions where a waveform spike follows a quasi-periodic voiced frame, the half-a-frame-at-a-time waveform extension approach above will generally cause audible artifacts and therefore should not be used. In this case, other methods to smoothly extend the voiced waveform before the waveform spike should be used. For example, typical periodic waveform extrapolation techniques that are common in packet loss concealment (PLC) methods can be used to extend the voiced waveform before the waveform spike and achieve the same effect of delaying the waveform spike by at least (SS−SA) samples as in Step 1 of the algorithm above. Regardless of which method is used to extend the waveform, as long as the voiced waveform is extended smoothly without audible artifacts and the waveform spike is then copied from the input buffer to the output buffer with at least (SS−SA) samples of delay, then the waveform spike duplication will be avoided and the speech quality degradation due to the corresponding buzzy sound will be eliminated.

It was found that, in certain implementations, when the waveform spike duplication avoidance technique described above is used in conjunction with the TSM scheme with dynamically changing speed factor (where low or no compression is applied to transient regions of speech and high compression is used elsewhere), the resulting output speech after TSM compression and subsequent expansion of the uncoded speech has fairly good quality with a compression ratio of 1.5 applied to all speech segments other than transient regions. Even at a compression ratio of 2.0 for all but the transient regions, the speech quality is still quite acceptable in casual listening. This demonstrates the effectiveness of the variable-speed TSM technique and the technique to eliminate waveform spike duplication during TSM expansion.

F. Example Multi-Mode, Variable-Bit-Rate Coding Implementation

An example multi-mode, variable-bit-rate codec will now be described that utilizes dynamic TSM compression and decompression to achieve a reduced coding bit rate in accordance with an embodiment of the present invention.

The objectives of the codec described in this section are the same as those of conventional speech codecs. However, its specific design characteristics make it unique compared to the conventional codecs. In targeted speech or audio storage applications, the encoded bit-stream of the input speech or audio signal is pre-stored in a system device, and only a decoding part is operated in a real-time manner. Channel errors and encoding delay are not critical issues. However, an average bit-rate and the decoding complexity of the codec should be as small as possible due to limitations of memory space and computational complexity.

Even with relaxed constraints on encoding complexity, encoding delay, and channel-error robustness, it is still a challenge to generate high-quality speech at a bit-rate of 4 to 5 kbit/s, which is the target bit-rate of the codec described in this section. The core encoding described in this section is a variant of the BV16 codec as described by J.-H. Chen and J. Thyssen in "The BroadVoice Speech Coding Algorithm," Proceedings of 2007 IEEE International Conference on Acoustics, Speech, and Signal Processing, pp. IV-537-IV-540, April 2007, the subject matter of which has been incorporated by reference herein. However, the speech codec described in this section incorporates several novel techniques to exploit the unique opportunity to have increased encoding complexity, increased encoding delay, and reduced robustness to channel errors.

In accordance with one implementation, the multiple-mode, variable-bit-rate speech codec described in this section selects a coding mode for each frame of an input speech signal, wherein the mode is determined in a closed-loop manner by trying out all possible coding modes for that frame and then selecting a winning coding mode using a sophisticated mode-decision logic based on a perceptually motivated psychoacoustic hearing model. This approach will normally result in very high encoding complexity and will make the resulting encoder impractical. However, by recognizing that the encoding complexity is not a concern for audio books, talking toys, and voice prompts applications, an embodiment of the multi-mode, variable-bit-rate speech codec uses such sophisticated high-complexity mode-decision logic to try to achieve the best possible speech quality.

1. Multi-Mode Coding

A multi-mode coding technique has been introduced to reduce average bit-rate while maintaining high perceptual quality. Although this technique utilizes flag bits to inform which encoding mode is used for the specified frame, it can save redundant bits that do not play a major role in generating high quality speech. For example, virtually no bits are needed for silence frames, and pitch related parameters can be disregarded for synthesizing unvoiced frames. The codec described in this section has four different encoding modes: silence, unvoiced, stationary voiced, and non-stationary voiced (or onset). The brief encoding guideline of each mode is summarized in Table 1.

TABLE 1

Multi-Mode Encoding Scheme

| Mode | Signal characteristics in general | Description |
|---|---|---|
| 0 | Silence | No bits are allocated to any parameters |
| 1 | Unvoiced | Allocates a small number of bits to spectral parameters<br>No bits are allocated to periodic excitation<br>Only non-periodic excitation vectors are used |
| 2 | Stationary voiced | Allocates a relatively large number of bits to spectral parameters<br>Use both periodic and non-periodic excitation vectors |
| 3 | Non-stationary voiced | Allocates a relatively large number of bits to spectral parameters<br>Uses both periodic and non-periodic excitation vectors<br>Decreases the vector dimension of random excitation codeword to improve quality in onset regions |

To efficiently design a multi-mode encoding scheme, it is very important to select an appropriate encoding mode for each frame because the average bit-rate and perceptual quality are varied depending on the ratio of choosing each encoding mode. A silence region can be easily detected by comparing the energy level of the encoded frame with that of the reference background noise frames. However, many features representing spectral and/or temporal characteristics are needed to accurately classify active voice frames into one of voiced, unvoiced, or onset modes. Conventional multi-mode coding approaches adopt a sequential approach such that an encoding mode of the frame is first determined, and then input signals are encoded using the determined encoding method. Since the complexity of the decision logic is relatively low compared to full encoding methods, this approach has been successfully deployed into real-time communication systems. However, the quality drops significantly if the decision logic fails to find a correct encoding mode.

Since the codec described in this section does not have stringent requirements for encoding complexity, a more robust algorithm can be used. In particular, the codec described herein adopts a closed-loop full search method such that the final encoding mode is determined by comparing similarities of the output signals of different encoding modes to the reference input signal. FIG. 12 is a block diagram of a multi-mode encoder 1200 in accordance with this approach while FIG. 13 is a block diagram of a multi-mode decoder 1300 in accordance with this approach.

As shown in FIG. 12, multi-mode encoder 1200 includes a silence detection module 1202, silence decision logic 1204, a mode 0 TSM compression and encoding module 1206, a multi-mode encoding module 1208, mode decision logic 1210, a memory update module 1212, a final TSM compression and encoding module 1214 and a bit packing module 1216.

Silence detection module 1202 analyzes signal characteristics associated with a current frame of the input speech signal that can be used to estimate if the current frame represents silence. Based on the analysis performed by silence detection module 1202, silence decision logic 1204 determines whether or not the current frame represents silence. If silence decision logic 1204 determines that the current frame represents silence, then the frame is TSM compressed using a TSM compression ratio associated with mode 0 and then encoded using mode 0 encoding by mode 0 TSM compression and encoding module 1206. The encoded TSM-compressed frame is then output to bit packing module 1216.

If silence decision logic 1204 determines that the current frame does not represent silence, then the current frame is deemed an active voice frame. For active voice frames, multi-mode encoding module 1208 first generates decoded signals using all encoding modes: mode 1, 2, and 3. Mode decision logic 1210 calculates similarities between the reference input speech signal and all decoded signals by subjectively-motivated measures. Mode decision logic 1210 determines the final encoding mode by considering both the average bit-rate and perceptual quality. Final TSM compression and encoding module 1214 applies TSM compression to the current frame using a TSM compression ratio associated with the final encoding mode and then encodes the TSM-compressed frame in accordance with the final encoding mode. Memory update module 1212 updates a look-back memory of the encoding parameter by the output of the selected encoding mode. Bit packing module 1216 operates to combine the encoded parameters associated with a TSM-compressed frame for storage as part of an encoded bit-stream.

In one embodiment, the mode decision rendered by mode decision logic 1210 may also take into account an estimate of the distortion that would be introduced by performing TSM compression and/or decompression in accordance with the TSM compression and/or decompression ratios associated with each encoding mode.

As shown in FIG. 13, multi-mode decoder 1300 includes a bit unpacking module 1302 and a mode-dependent decoding and TSM decompression module 1304. Bit unpacking module 1302 receives the encoded bit stream as input and extracts a set of encoded parameters associated with a current TSM-compressed frame therefrom, including one or more bits that indicate which mode was used to encode the parameters. Mode-dependent decoding and TSM decompression module 1304 performs one of a plurality of different decoding processes to decode the encoded parameters depending on the one or more mode bits extracted by bit unpacking module 1302, thereby producing a decoded TSM-compressed frame. Mode-dependent decoding and TSM decompression module 1304 then applies TSM decompression to the decoded TSM-compressed frame using a TSM decompression ratio associated with the appropriate decoding mode, thereby generating a decoded TSM-decompressed segment. This decoded TSM-decompressed segment is then output as part of an output speech signal.

2. Core Codec Structure and Bit Allocations

In an embodiment, the multi-mode, variable-bit rate codec utilizes four different encoding modes. Since no bits are needed for mode 0 (silence) except two bits for mode information, there are three encoding methods (mode 1, 2, 3) to be designed carefully. The baseline codec structure of one embodiment of the multi-mode, variable-bit rate codec is taken from the BV16 codec that has been adopted as a standard speech codec for voice communications through digital cable networks. See "BV16 Speech Codec Specification for Voice over IP Applications in Cable Telephony," American National Standard, ANSI/SCTE 24-21 2006, the entirety of which is incorporated by reference herein.

Mode 1 is designed for handling unvoiced frames, thus it does not need any pitch-related parameters for the long-term prediction module. Modes 2 and 3 are mainly used for voiced or transition frames, thus encoding parameters are almost equivalent to the BV16. Differences between the BV16 and a multi-mode, variable-bit-rate codec in accordance with an embodiment may include frame/sub-frame lengths, the number of coefficients for short-term linear prediction, inter-frame predictor order for LSP quantization, vector dimension of the excitation codebooks, and allocated bits to transmitted codec parameters.

G. Example Computer System Implementation

It will be apparent to persons skilled in the relevant art(s) that various elements and features of the present invention, as described herein, may be implemented in hardware using analog and/or digital circuits, in software, through the execution of instructions by one or more general purpose or special-purpose processors, or as a combination of hardware and software.

The following description of a general purpose computer system is provided for the sake of completeness. Embodiments of the present invention can be implemented in hardware, or as a combination of software and hardware. Consequently, embodiments of the invention may be implemented in the environment of a computer system or other processing system. An example of such a computer system 1400 is shown in FIG. 14. All of the logic blocks depicted in FIGS. 1-3, 5, 7, 9, 12 and 13, for example, can execute on one or more distinct computer systems 1400. Furthermore, each of the steps of the flowcharts depicted in FIGS. 4, 6, 8, 10 and 11 can be implemented on one or more distinct computer systems 1400.

Computer system 1400 includes one or more processors, such as processor 1404. Processor 1404 can be a special purpose or a general purpose digital signal processor. Processor 1404 is connected to a communication infrastructure 1402 (for example, a bus or network). Various software implementations are described in terms of this exemplary computer system. After reading this description, it will become apparent to a person skilled in the relevant art(s) how to implement the invention using other computer systems and/or computer architectures.

Computer system 1400 also includes a main memory 1406, preferably random access memory (RAM), and may also include a secondary memory 1420. Secondary memory 1420 may include, for example, a hard disk drive 1422 and/or a removable storage drive 1424, representing a floppy disk drive, a magnetic tape drive, an optical disk drive, or the like. Removable storage drive 1424 reads from and/or writes to a removable storage unit 1428 in a well known manner. Removable storage unit 1428 represents a floppy disk, magnetic tape, optical disk, or the like, which is read by and written to by removable storage drive 1424. As will be appreciated by persons skilled in the relevant art(s), removable storage unit 1428 includes a computer usable storage medium having stored therein computer software and/or data.

In alternative implementations, secondary memory 1420 may include other similar means for allowing computer programs or other instructions to be loaded into computer system 1400. Such means may include, for example, a removable storage unit 1430 and an interface 1426. Examples of such means may include a program cartridge and cartridge interface (such as that found in video game devices), a removable memory chip (such as an EPROM, or PROM) and associated socket, a thumb drive and USB port, and other removable storage units 1430 and interfaces 1426 which allow software and data to be transferred from removable storage unit 1430 to computer system 1400.

Computer system 1400 may also include a communications interface 1440. Communications interface 1440 allows software and data to be transferred between computer system 1400 and external devices. Examples of communications interface 1440 may include a modem, a network interface (such as an Ethernet card), a communications port, a PCMCIA slot and card, etc. Software and data transferred via communications interface 1440 are in the form of signals which may be electronic, electromagnetic, optical, or other signals capable of being received by communications interface 1440. These signals are provided to communications interface 1440 via a communications path 1442. Communications path 1442 carries signals and may be implemented using wire or cable, fiber optics, a phone line, a cellular phone link, an RF link and other communications channels.

As used herein, the terms "computer program medium" and "computer readable medium" are used to generally refer to tangible storage media such as removable storage units 1428 and 1430 or a hard disk installed in hard disk drive 1422. These computer program products are means for providing software to computer system 1400.

Computer programs (also called computer control logic) are stored in main memory 1406 and/or secondary memory 1420. Computer programs may also be received via communications interface 1440. Such computer programs, when executed, enable the computer system 1400 to implement the present invention as discussed herein. In particular, the computer programs, when executed, enable processor 1404 to implement the processes of the present invention, such as any of the methods described herein. Accordingly, such computer programs represent controllers of the computer system 1400. Where the invention is implemented using software, the software may be stored in a computer program product and loaded into computer system 1400 using removable storage drive 1424, interface 1426, or communications interface 1440.

In another embodiment, features of the invention are implemented primarily in hardware using, for example, hardware components such as application-specific integrated circuits (ASICs) and gate arrays. Implementation of a hardware state machine so as to perform the functions described herein will also be apparent to persons skilled in the relevant art(s).

H. Conclusion

While various embodiments of the present invention have been described above, it should be understood that they have been presented by way of example only, and not limitation. It will be understood by those skilled in the relevant art(s) that various changes in form and details may be made to the embodiments of the present invention described herein without departing from the spirit and scope of the invention as defined in the appended claims. Accordingly, the breadth and scope of the present invention should not be limited by any of the above-described exemplary embodiments, but should be defined only in accordance with the following claims and their equivalents.

What is claimed is:

1. A method for generating an encoded representation of an audio signal comprising a series of temporally-ordered segments, the method comprising, for each segment of the audio signal:

selecting one of a plurality of different encoding modes;

selecting one of a plurality of different time scale modification (TSM) compression ratios based on the selected encoding mode, wherein each of the plurality of different TSM compression ratios is greater than 1;

applying TSM compression to the segment using the selected TSM compression ratio to generate a TSM-compressed segment; and applying encoding to the TSM-compressed segment in accordance with the selected encoding mode to generate an encoded TSM-compressed segment;

wherein the encoded TSM-compressed segment includes one or more mode bits that are useable by a decoder to determine which encoding mode was used in encoding the TSM-compressed segment and which TSM compression ratio was used in applying TSM compression to the segment, wherein at least one of the selecting or applying steps is performed by a processing unit or an integrated circuit.

2. The method of claim 1, wherein selecting one of the plurality of different encoding modes comprises:

selecting one of the plurality of different encoding modes based on local characteristics of the audio signal.

3. The method of claim 1, wherein selecting one of the plurality of different encoding modes comprises:

selecting one of an encoding mode for silence segments, an encoding mode for unvoiced speech segments, an encoding mode for stationary voiced speech segments and an encoding mode for non-stationary voiced speech segments.

4. The method of claim 1, wherein selecting one of the plurality of different encoding modes comprises:

determining an estimated amount of distortion that will be introduced by applying TSM compression to the segment using a TSM compression ratio associated with each encoding mode; and selecting one of the plurality of different encoding modes based at least in part on the estimated amounts of distortion.

5. The method of claim 1, wherein selecting one of the plurality of different encoding modes comprises:

determining an estimated amount of distortion that will be introduced by applying TSM compression to the segment using a TSM compression ratio associated with each encoding mode and by applying TSM decompression to the TSM-compressed segment using a TSM decompression ratio associated with each encoding mode; and selecting one of the plurality of different encoding modes based at least in part on the estimated amounts of distortion.

6. A method for decoding an encoded representation of an audio signal comprising a series of temporally-ordered segments, the method comprising, for each segment of the audio signal:

receiving an encoded time scale modification (TSM) compressed segment of the audio signal;

selecting one of a plurality of different decoding modes for decoding the encoded TSM-compressed segment based on one or more mode bits included in the encoded TSM-compressed segment;

applying decoding to the encoded TSM-compressed segment in accordance with the selected decoding mode to generate a decoded TSM-compressed segment;

selecting one of a plurality of different TSM decompression ratios based on the selected decoding mode, wherein each of the plurality of different TSM decompression ratios is less than 1; and applying TSM decompression to the decoded TSM-compressed segment using the selected TSM decompression ratio to generate a decoded TSM-decompressed segment of the audio signal;

wherein at least one of the selecting or applying steps is performed by a processing unit or an integrated circuit.

7. The method of claim 6, wherein selecting one of the plurality of different decoding modes for decoding the encoded TSM-compressed segment based on the one or more mode bits comprises selecting one of a decoding mode for silence segments, a decoding mode for unvoiced speech segments, a decoding mode for stationary voiced speech segments and a decoding mode for non-stationary voiced speech segments.

8. The method of claim 6, wherein applying TSM decompression to the decoded TSM-compressed segment to generate the decoded TSM-decompressed segment of the audio signal comprises:

performing a process to avoid the duplication of waveform spikes appearing in the decoded TSM-compressed segment.

9. The method of claim 8, wherein performing the process to avoid the duplication of waveform spikes appearing in the decoded TSM-compressed segment comprises:

(a) responsive to determining that the decoded TSM-compressed segment corresponds to silence or unvoiced speech and a waveform spike appears within the next two segments of a decoded TSM-compressed signal of which the decoded TSM-compressed segment is a part:

(i) extending the decoded TSM-compressed segment in a portion of an input buffer x(1:SA) half a segment at a time for $$\left\lceil \frac{(SS - SA)}{(WS/2)} \right\rceil$$

times, wherein SA is the size of the decoded TSM-compressed segment prior to the application of TSM decompression, SS is the size of the decoded TSM-compressed segment after the application of TSM decompression, and WS is the size of an overlap-add window used in applying TSM decompression;

(ii) copying a waveform in a portion of the input buffer x(SA+1:3SA) to fill up an output buffer y'(k) from which the decoded TSM-decompressed segment is obtained; and (b) responsive to determining that the decoded TSM-compressed segment does not correspond to silence or unvoiced speech or that a waveform spike does not appear within the next two segments of the decoded TSM-compressed signal, copying a waveform in a portion of the input buffer x(SA+1:3SA) to fill up the output buffer y'(k) from which the decoded TSM-decompressed segment is obtained.

10. An apparatus comprising:

an encoding mode selector, implemented by a processing unit, that selects one of a plurality of different encoding modes for encoding a segment of an audio signal;

a time scale modification (TSM) compressor that selects one of a plurality of different TSM compression ratios based on the selected encoding mode and applies TSM compression to the segment using the selected TSM compression ratio to generate a TSM-compressed segment, wherein each of the plurality of different TSM compression ratios is greater than 1; and a multi-mode encoder that applies encoding to the TSM-compressed segment in accordance with the selected encoding mode to generate an encoded TSM-compressed segment, wherein the encoded TSM-compressed segment includes one or more mode bits that are useable by a decoder to determine which encoding mode was used to encode the TSM-compressed segment and which TSM compression ratio was used in applying TSM-compression to the segment.

11. The apparatus of claim 10, wherein the encoding mode selector selects one of an encoding mode for silence segments, an encoding mode for unvoiced speech segments, an encoding mode for stationary voiced speech segments or an encoding mode for non-stationary voice speech segments for encoding the segment.

12. The apparatus of claim 10, wherein the encoding mode selector determines an estimated amount of distortion that will be introduced by applying TSM compression to the segment using a TSM compression ratio associated with each encoding mode and selects one of the plurality of different encoding modes based at least in part on the estimated amounts of distortion.

13. The apparatus of claim 10, wherein the encoding mode selector determines an estimated amount of distortion that will be introduced by applying TSM compression to the segment using a TSM compression ratio associated with each encoding mode and by applying TSM decompression to the TSM-compressed segment using a TSM decompression ratio associated with each encoding mode and selects one of the plurality of different encoding modes based at least in part on the estimated amounts of distortion.

14. The apparatus of claim 10, wherein the encoding mode selector selects one of the plurality of different encoding modes based on local characteristics of the audio signal.

15. An apparatus, comprising:

a decoder, implemented by a processing unit, that receives an encoded time scale modification (TSM) compressed segment of an audio signal that includes one or more mode bits, selects one of a plurality of different decoding modes for decoding the encoded TSM-compressed segment based on the one or more mode bits, and applies decoding thereto in accordance with the selected decoding mode to generate a decoded TSM-compressed segment; and a TSM de-compressor that selects one of a plurality of different TSM decompression ratios based on the one or more mode bits, and that applies TSM decompression to the decoded TSM-compressed representation of the segment using the selected TSM decompression ratio to generate a decoded TSM-decompressed segment of the audio signal, wherein each of the plurality of different TSM decompression ratios is less than 1.

16. The apparatus of claim 15, wherein the decoder selects one of a decoding mode for silence segments, a decoding mode for unvoiced speech segments, a decoding mode for stationary voiced speech segments and a decoding mode for non-stationary voice speech segments for decoding the TSM-encoded segment.

17. The apparatus of claim 15, wherein the TSM de-compressor performs a process to avoid the duplication of waveform spikes appearing in the decoded TSM-compressed segment in the decoded TSM-decompressed segment.

18. A method for applying time scale modification (TSM) expansion to an audio signal that avoids the duplication of waveform spikes appearing in the audio signal, comprising:

(a) responsive to determining that a segment of the audio signal corresponds to silence or unvoiced speech and a waveform spike appears within the next two segments of the audio signal:

(i) extending the segment in a portion of an input buffer x(1:SA) half a segment at a time for $$\left\lceil \frac{(SS - SA)}{(WS/2)} \right\rceil$$

times, wherein SA is the size of the segment prior to the application of TSM expansion, SS is the size of the segment after the application of TSM expansion, and WS is the size of an overlap-add window used in applying TSM expansion;

(ii) copying a waveform in a portion of the input buffer x(SA+1:3SA) to fill up an output buffer y'(k) from which an expanded version of the segment is obtained; and (b) responsive to determining that the segment of the audio signal does not correspond to silence or unvoiced speech or that a waveform spike does not appear within the next two segments of the audio signal, copying a waveform in a portion of the input buffer x(SA+1:3SA) to fill up the output buffer y'(k) from which the expanded version of the segment is obtained;

wherein at least one of the extending or copying steps is performed by a processing unit or an integrated circuit.

19. A computer program product comprising a computer readable storage device having computer program logic recorded thereon for enabling a processor to decode an encoded representation of an audio signal comprising a series of temporally-ordered segments, the computer program logic comprising:

a first program logic module for enabling the processor to receive an encoded time scale modification (TSM) compressed segment of the audio signal;

a second program logic module for enabling the processor to select one of a plurality of different decoding modes for decoding the encoded TSM-compressed segment based on one or more mode bits included in the encoded TSM-compressed segment;

a third program logic module for enabling the processor to apply decoding to the encoded TSM-compressed segment in accordance with the selected decoding mode to generate a decoded TSM-compressed segment;

a fourth program logic module for enabling the processor to select one of a plurality of different TSM decompression ratios based on the selected decoding mode, wherein each of the plurality of different TSM decompression ratios is less than 1; and a fifth program logic module for enabling the processor to apply TSM decompression to the decoded TSM-compressed segment using the selected TSM decompression ratio to generate a decoded TSM-decompressed segment of the audio signal.

20. The computer program product of claim 19, wherein the plurality of different decoding modes include a decoding mode for silence segments, a decoding mode for unvoiced speech segments, a decoding mode for stationary voiced speech segments and a decoding mode for non-stationary voiced speech segments.

21. The computer program product of claim 19, further comprising:

a sixth program logic module for enabling the processor to perform a process to avoid the duplication of waveform spikes appearing in the decoded TSM-compressed segment.

22. The computer program product of claim 21, wherein the sixth program logic module comprises logic for enabling the processor to:

(a) responsive to determining that the decoded TSM-compressed segment corresponds to silence or unvoiced speech and a waveform spike appears within the next two segments of a decoded TSM-compressed signal of which the decoded TSM-compressed segment is a part:

(i) extend the decoded TSM-compressed segment in a portion of an input buffer x(1:SA) half a segment at a time for $$\left\lceil \frac{(SS - SA)}{(WS/2)} \right\rceil,$$

times, wherein SA is the size of the decoded TSM-compressed segment prior to the application of TSM decompression, SS is the size of the decoded TSM-compressed segment after the application of TSM decompression, and WS is the size of an overlap-add window used in applying TSM decompression;

(ii) copy a waveform in a portion of the input buffer x(SA+1:3SA) to fill up an output buffer y'(k) from which the decoded TSM-decompressed segment is obtained; and (b) responsive to determining that the decoded TSM-compressed segment does not correspond to silence or unvoiced speech or that a waveform spike does not appear within the next two segments of the decoded TSM-compressed signal, copy a waveform in a portion of the input buffer x(SA+1:3SA) to fill up the output buffer y'(k) from which the decoded TSM-decompressed segment is obtained.

* * * * *